US009083110B2

(12) United States Patent
McClelland

(10) Patent No.: US 9,083,110 B2
(45) Date of Patent: Jul. 14, 2015

(54) QUICK-DISCONNECT POWER ADAPTERS

(71) Applicant: Todd McClelland, Atlanta, GA (US)

(72) Inventor: Todd McClelland, Atlanta, GA (US)

(73) Assignee: Todd Doobrow, Birmingham, AL (US)

( * ) Notice: Subject to any disclaimer, the term of this patent is extended or adjusted under 35 U.S.C. 154(b) by 43 days.

(21) Appl. No.: 13/645,237

(22) Filed: Oct. 4, 2012

(65) Prior Publication Data

US 2014/0099808 A1 Apr. 10, 2014

Related U.S. Application Data

(60) Provisional application No. 61/543,090, filed on Oct. 4, 2011.

(51) Int. Cl.

| | |
|---|---|
| ***H01R 11/30*** | (2006.01) |
| ***H01R 13/62*** | (2006.01) |
| ***H01R 31/06*** | (2006.01) |
| *H01R 103/00* | (2006.01) |
| *H01R 13/703* | (2006.01) |
| *H01R 13/717* | (2006.01) |
| *H01R 24/70* | (2011.01) |

(52) U.S. Cl.

CPC ..... *H01R 13/6205* (2013.01); *H01R 31/06* (2013.01); *H01R 13/703* (2013.01); *H01R 13/717* (2013.01); *H01R 24/70* (2013.01); *H01R 2103/00* (2013.01)

(58) Field of Classification Search

CPC ..... H01R 13/6205; H01R 13/6275; H01R 13/633; H01R 13/6395; H01R 13/6397

USPC ..... 439/38–40, 180, 304, 345, 373

See application file for complete search history.

(56) References Cited

U.S. PATENT DOCUMENTS

| | | | | |
|---|---|---|---|---|
| 3,363,214 | A * | 1/1968 | Wright | 439/39 |
| 3,808,577 | A * | 4/1974 | Mathauser | 439/39 |
| 4,494,809 | A | 1/1985 | Soloman | |
| 5,096,432 | A | 3/1992 | Cullen et al. | |
| 5,812,356 | A | 9/1998 | O'Connor | |
| 5,829,987 | A * | 11/1998 | Fritsch et al. | 439/38 |
| 5,921,783 | A * | 7/1999 | Fritsch et al. | 439/38 |
| 6,358,076 | B1 | 3/2002 | Haag | |
| 6,623,276 | B2 * | 9/2003 | Dalmau Ferrerfabrega et al. | 439/39 |

(Continued)

FOREIGN PATENT DOCUMENTS

| | | | |
|---|---|---|---|
| DE | 102008038641 | A1 | 3/2009 |
| GB | 1232922 | A | 5/1971 |

(Continued)

OTHER PUBLICATIONS

European Search Report, dated Apr. 14, 2015, from corresponding European Application No. 12837873.4.

*Primary Examiner* — Thanh Tam Le

(74) *Attorney, Agent, or Firm* — Brient Globerman, LLC

(57) ABSTRACT

A quick disconnect power adapter for maintaining a connection between a plug and a receptacle. In various embodiments, the quick disconnect power adapter maintains a completed circuit for providing power from a power source to an electrical device with a releasable fastener. In particular embodiments, the releasable fastener includes one or more magnets. In various embodiments, the quick disconnect power adapter is configured such that the electrical contact points of the plug and receptacle cannot be touched or otherwise contacted by a user when the plug and receptacle are not engaged.

19 Claims, 19 Drawing Sheets

(56) References Cited

U.S. PATENT DOCUMENTS

| | | | | |
|---|---|---|---|---|
| 7,329,128 | B1 * | 2/2008 | Awad | 439/38 |
| 7,331,793 | B2 * | 2/2008 | Hernandez et al. | 439/38 |
| 7,341,458 | B1 * | 3/2008 | Koh | 439/39 |
| 7,344,380 | B2 * | 3/2008 | Neidlein et al. | 439/39 |
| 7,498,546 | B2 * | 3/2009 | Belongia et al. | 219/518 |
| 7,645,143 | B2 * | 1/2010 | Rohrbach et al. | 439/39 |
| 7,658,613 | B1 * | 2/2010 | Griffin et al. | 439/39 |
| 7,775,801 | B2 * | 8/2010 | Shiff et al. | 439/39 |

FOREIGN PATENT DOCUMENTS

| | | | |
|---|---|---|---|
| JP | 2008-153182 | A | 7/2008 |
| WO | 95/31018 | A1 | 11/1995 |
| WO | 2011088012 | A1 | 7/2011 |

* cited by examiner

QUICK-DISCONNECT POWER ADAPTERS

1. CROSS-REFERENCE TO RELATED APPLICATION

This application claims the benefit of U.S. Provisional Application No. 61/543,090, entitled "Quick-Disconnect Power Adapters", filed Oct. 4, 2011, which is hereby incorporated herein by reference in its entirety.

2. INTRODUCTION

Described herein are embodiments of an adapter that maintains a releasable connection between a plug and a receptacle. Embodiments of the adapter incorporate features, mechanisms or devices that reduce the likelihood of accidental electrocution when elements of the adapter are separated from each other or are otherwise not connected. Such features, mechanisms and devices include, but are not limited to, a switch that disables electric contacts of the adapter when the plug or plug element is not connected to the receptacle element of the adapter. Embodiments of the adapter may also or in the alternative include features, mechanisms and devices that prevent or reduce the likelihood that electrical contacts will be touched or accidentally contacted when the plug or plug element is not connected to the receptacle element of the adapter.

3. BACKGROUND

Anyone and everyone can trip on a power cord. The dangers and consequences of tripping on a power cord are present to children, the elderly, and everyone in between. Tripping occurs in the home, at school, in daycare facilities, in hospitals, in nursing homes, in factories, in restaurants, and other places. Consequences for an individual of tripping on a power cord can be severe, including breaking a wrist or fracturing a hip. Damage can also occur to the receptacle, plugged in devices and the plug itself. With increasing expenditures on expensive gadgets, tripping on a power cord can send such expensive gadgets crashing to the ground. Similarly, machinery in a factory may be easily damaged if a person trips on a connected power cord.

A common source of failure for electronic devices is the connection between a power cord and a plug. It is common for people to disconnect a plug from a receptacle by pulling on the power cord instead of the plug. Repeated strain on a power cord can damage the connection between the cord and the plug.

Most plugs are designed to release from a receptacle when a certain amount of force is applied in an axial or near-axial direction. However, the more horizontal the force applied to a plug, the more difficult it may be to remove the plug and to remove it without damaging the receptacle, plug, or the power cord.

In addition to the dangers of tripping on power cords, electrical sockets pose an electrocution risk to children and others who improperly use an electric socket. Children, for example, all too often will take paper clips, scissors, and other objects and insert them into electric sockets resulting in serious if not fatal electrocution to the child.

To address these problems, devices have been previously designed that allow for the quick release of an electrical plug from an electric socket. Certain types of appliances, such as deep fryers, have been designed with a quick release mechanism on the appliance. Devices have also been designed that involve inserting plastic plugs into receptacles such that children cannot insert objects into the sockets.

4. SUMMARY

An adapter for use in maintaining an electrical connection between an electrical device and an electrical outlet, according to particular embodiments, is adapted to facilitate a safe break in the electrical connection. In various embodiments, the adapter comprises: (1) a first connecter that comprises a first set of one or more electrical contacts; (2) a second connector that comprises a second set of one or more electrical contacts; (3) a releasable fastener that is adapted to form a releasable connection between the first connector and the second connector. In particular embodiments, the releasable connection between the first and second connectors is such that: (A) the first set of electrical contacts engages the second set of electrical contacts; and (b) the engagement between the first and second sets of contacts facilitates a communication of electrical current between the first and second connectors; and the releasable fastener is adapted so that an application of a sufficient force to the releasable fastener releases the connection between the first and second connectors so that the first set of electrical contacts disengages from the second set of electrical contracts.

An adapter for use in maintaining an electrical connection between an electrical device and a source of electricity, according to various embodiments, is adapted to facilitate a safe break in the electrical connection. In particular embodiments, the adapter comprises: (1) a first connector that comprises a first set of one or more electrical contacts; (2) a second connector that comprises a second set of one or more electrical contacts; and (3) a releasable fastener that is adapted to form a releasable connection between the first connector and the second connector. In various embodiments, the releasable connection between the first connector and the second connector is such that: (1) the first set of electrical contacts engages the second set of electrical contacts; and (2) the engagement between the first and second sets of contacts facilitates a communication of electrical current between the first and second connectors. In various embodiments, the releasable fastener is adapted so that an application of a sufficient force to the releasable fastener releases the connection between the first and second connectors so that the first set of electrical contacts disengages from the second set of electrical contacts. In particular embodiments, the first connector is a plug element disposed adjacent a distal end of a power cord for the electrical device, and the second connector is a receptacle element that is adapted to be plugged into the power source so that power flows from the power source to the electrical device through the first and second connectors and the power cord.

5. DIAGRAMS

The description of embodiments of adapters that follows will best be understood with reference to the figures in the drawings that accompany this application. Note that like reference numbers used in these drawings indicate similar components. It should be noted that the figures are not to scale and the proportional size of the illustrated embodiments varies and is not intended to be limiting.

FIGS. 6, 7, 8, 9, 10, and 11 illustrate direct views of plug faces and receptacle faces configured in accordance with alternative embodiments of an adapter.

Figure 12:
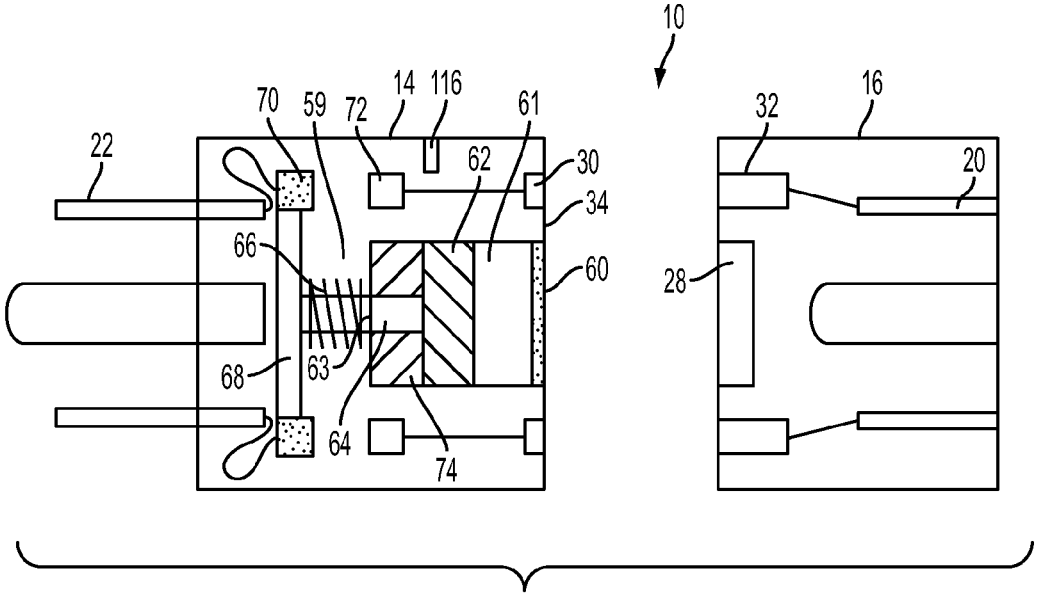
Figure 13:
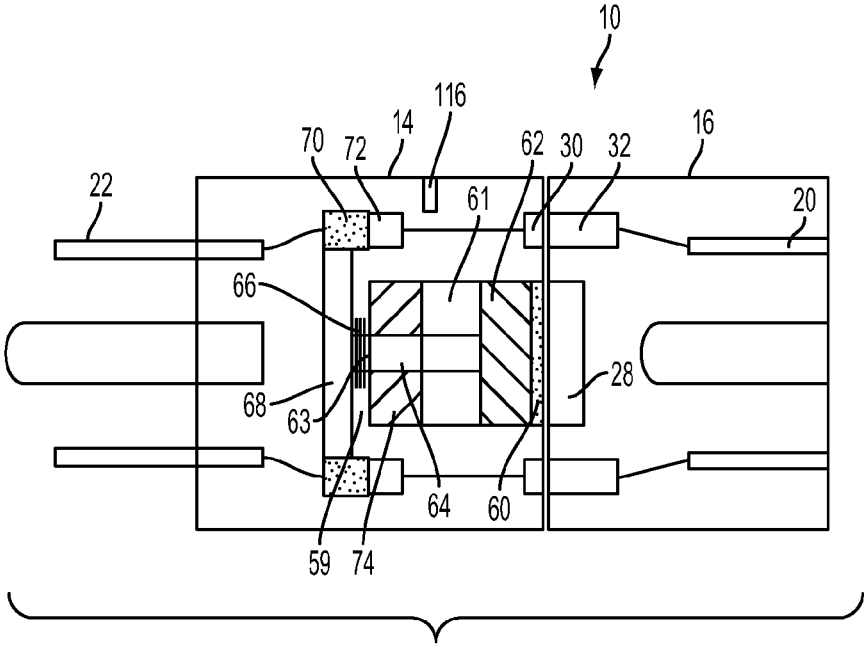

FIGS. 12 and 13 illustrate a cross-sectional view of an embodiment of an adapter including a piston safety feature.

FIGS. 14, 15, 16, 17, and 18 illustrate different perspectives and cross-sections of an embodiment of an adapter using a guard to reduce the likelihood of accidental contact to contacts on the receptacle element.

Figure 19:
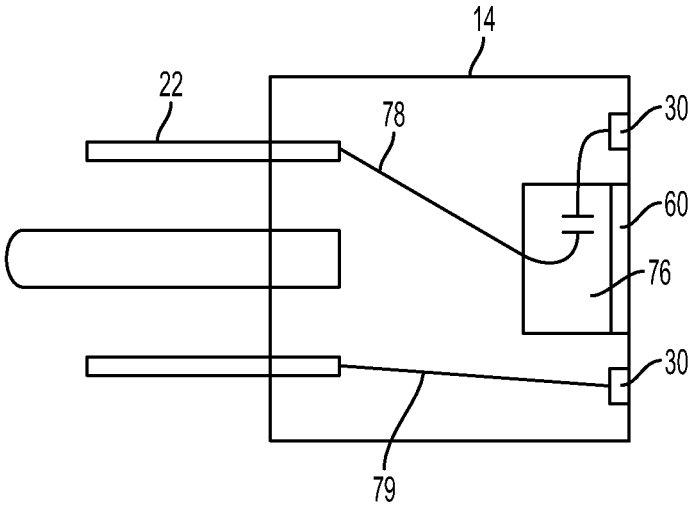

FIG. 19 illustrates a cross-sectional view of a receptacle element of an embodiment of an adapter using different types of switches that enable or disable receptacle side contacts.

Figure 20:
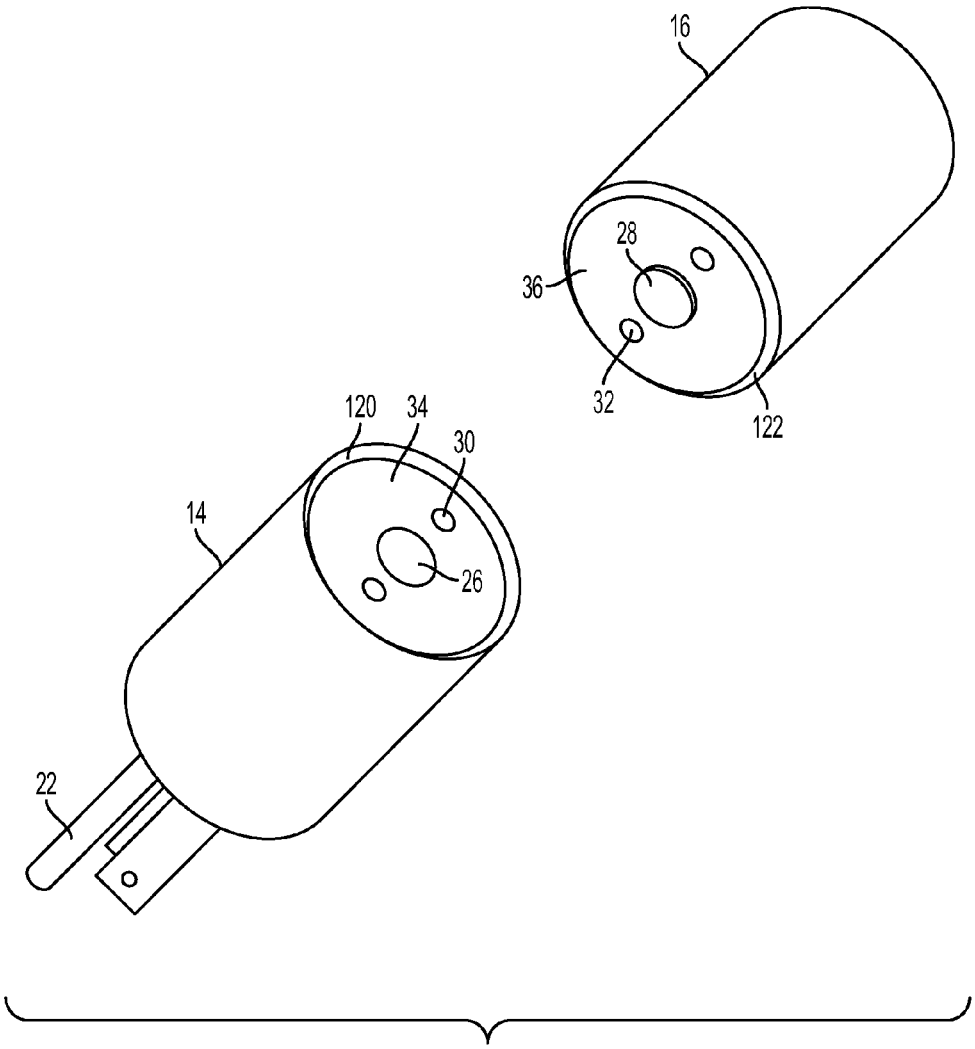

FIG. 20 illustrates a perspective view of an embodiment of an adapter including a lip and lip receiver to align the plug element and receptacle element and reduce slippage.

Figure 21:
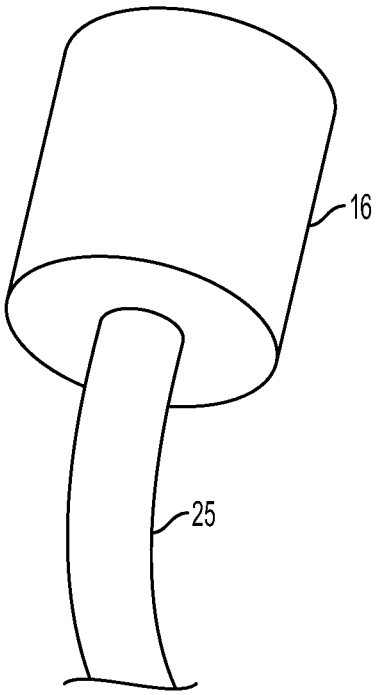

FIG. 21 illustrates a perspective view of an embodiment of an adapter where a power cord is wired into the plug element.

Figure 22:
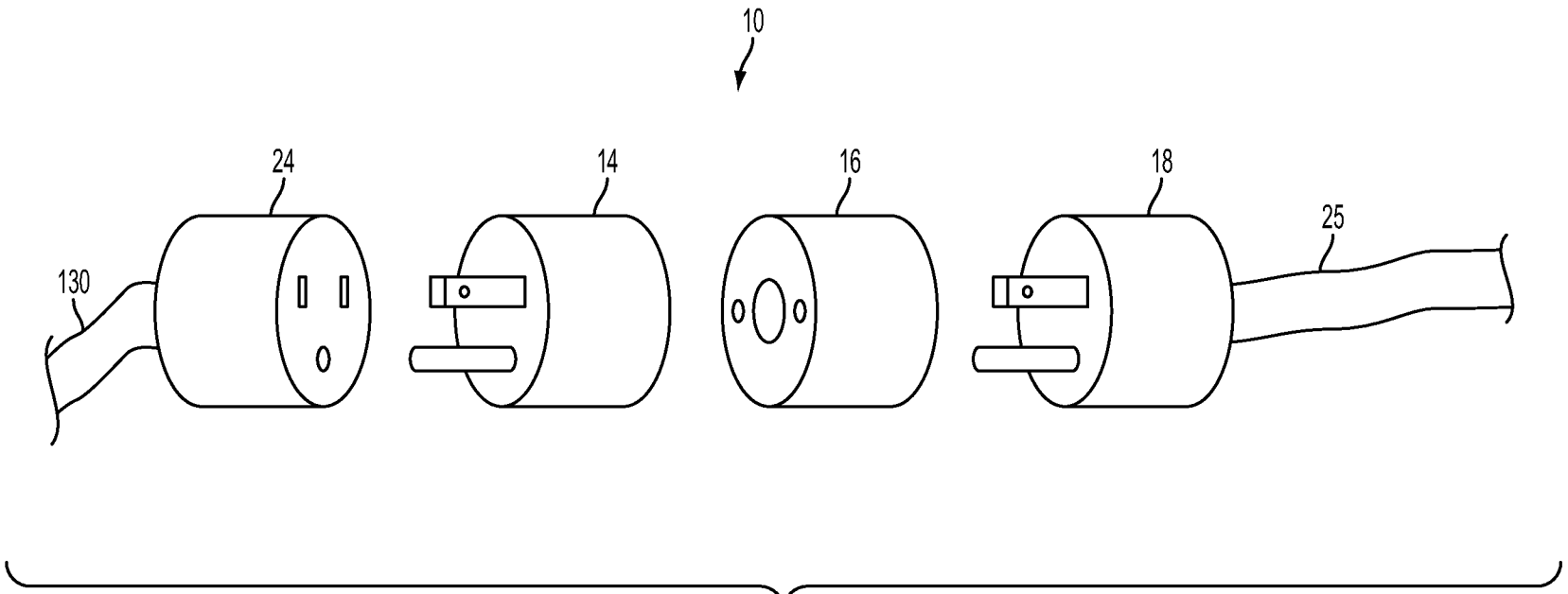

FIG. 22 illustrates a perspective view of an embodiment of an adapter where the receptacle is not static and is connected to a second power cord or other electrical or communication cord.

Figure 23:
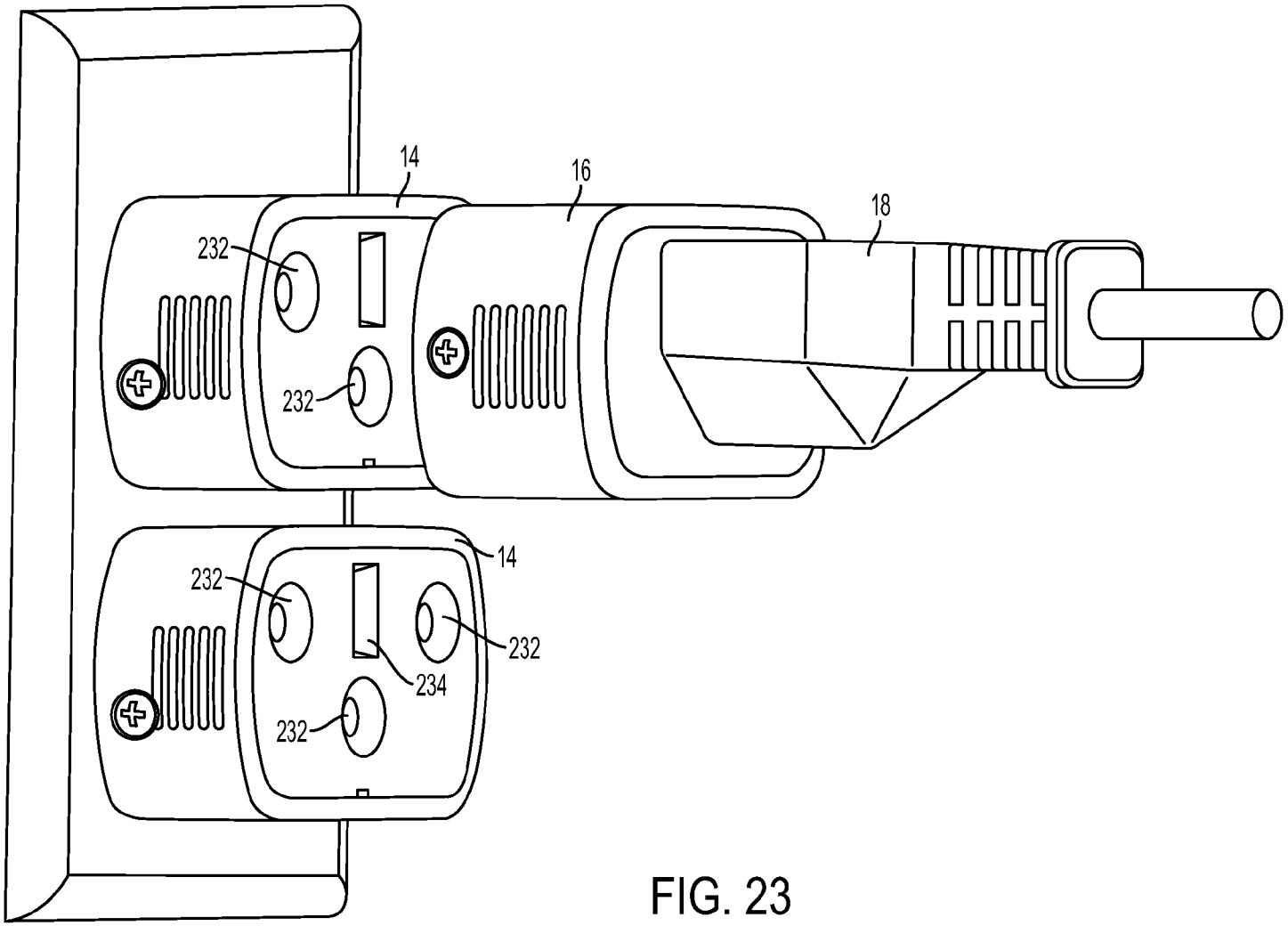

FIG. 23 illustrates a perspective view of an embodiment of an adapter according to yet another embodiment.

Figure 24:
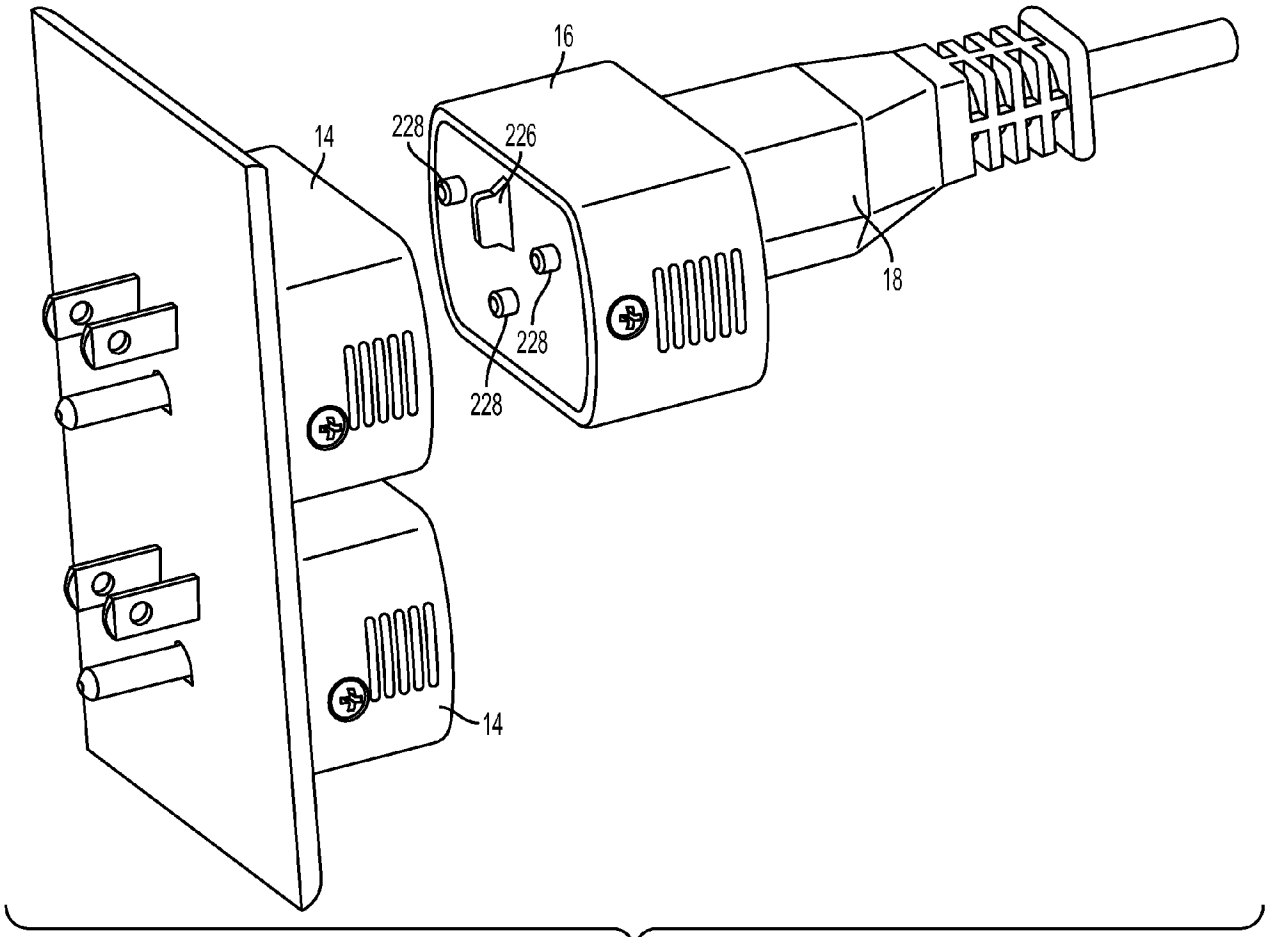

FIG. 24 illustrates an alternate perspective view of the embodiment of the adapter shown in FIG. 23.

Figure 25:
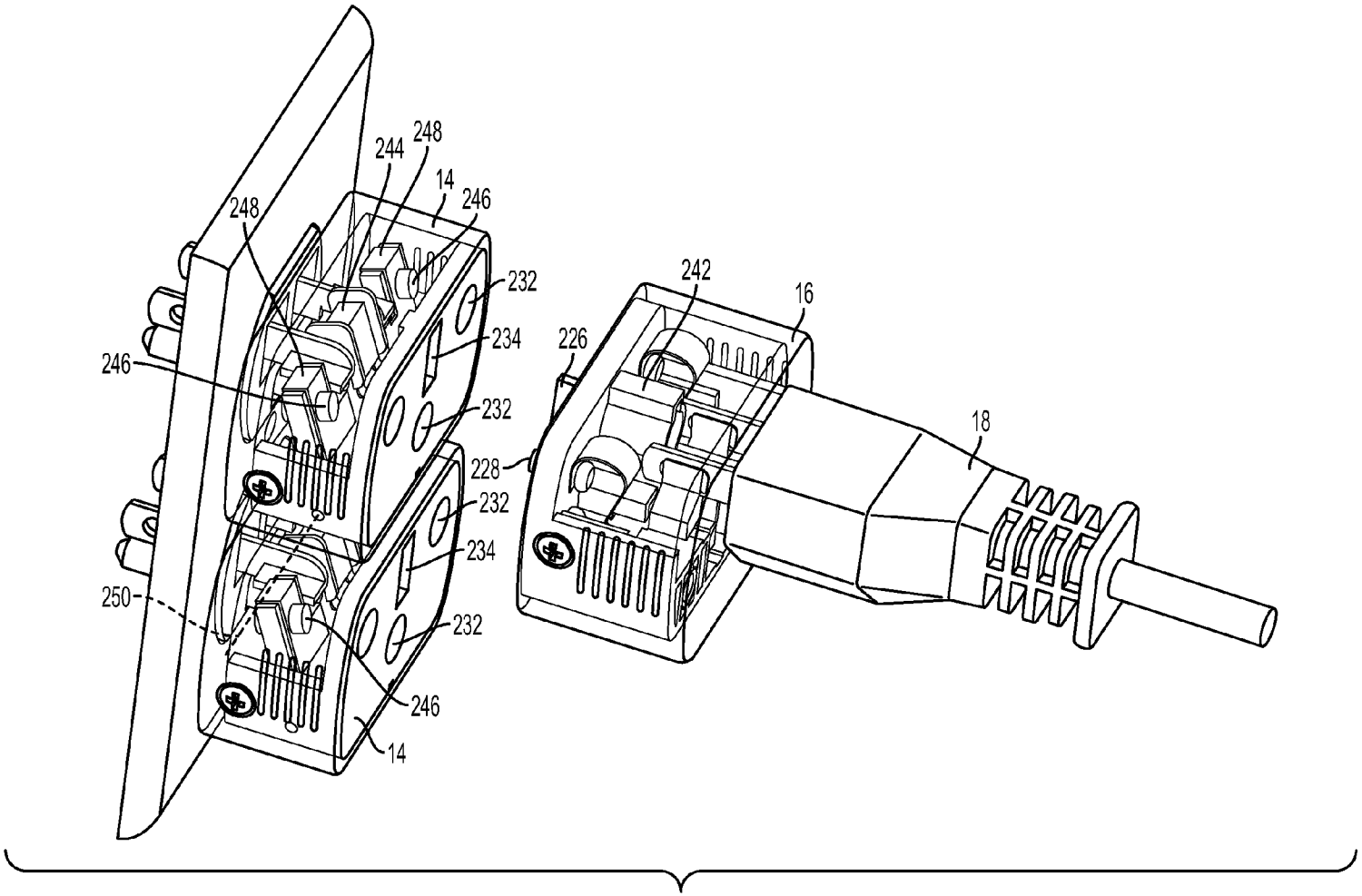

FIG. 25 illustrates a cross-sectional perspective view of the embodiment of the adapter shown in FIG. 23.

Figure 26:
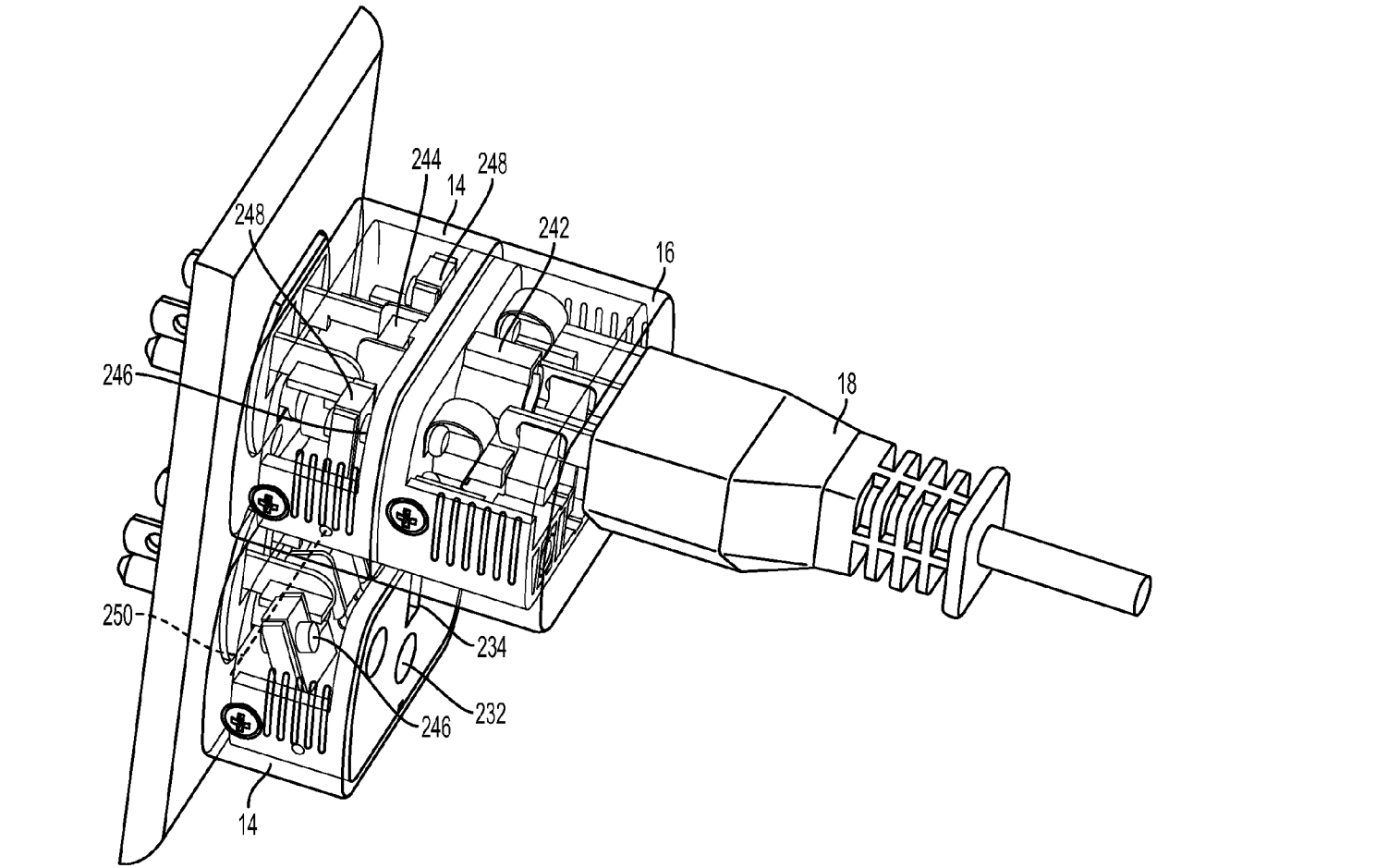

FIG. 26 illustrates a cross-sectional perspective view of the embodiment of the adapter shown in FIG. 23 with the adapter engaged.

6. ADAPTER BASICS

The embodiments of the adapter discussed generally below use two connecting elements (a plug element and a receptacle element) that connect together and maintain a releasable connection. Each of the elements of the adapter contains electrical contacts for creating an electrically conductive path from one end of the adapter that engages the receptacle, to the other end of the adapter that engages with a plug or that constitutes the plug. The adapter enables a plug using the adapter to release or breakaway from a connection to a receptacle when force is applied to the plug without damaging the receptacle or the plug. Using features, mechanisms or devices, such as but not limited to those discussed below, the adapter allows the plug or plug element to detach from a connection to the receptacle or receptacle element when the adapter experiences a sufficient level of force, whether an axial force or a horizontal force. Further, once the plug has detached from the receptacle, safety features, mechanisms or devices of the adapter render the receptacle element of the adapter safe from causing accidental electrocution. Embodiments of the adapter include safety features, mechanisms or devices that render contacts of the receptacle element of the adapter de-energized (that is, electric current will not flow) so as to prevent accidental electrocution. In addition or in the alternative, embodiments of the adapter include safety features, mechanisms or devices that make it difficult to touch contacts of the receptacle element or render such contacts unexposed when the plug element or plug is disengaged from the receptacle element.

7. Assumptions

In the discussion that follows, reference is made to plugs and receptacles. Such references are not intended to limit the applicability or features of the embodiments of the adapter. Plugs can mean any electrical plug design or configuration and of any current, voltage (e.g., 5 volts, 25 volts, 120 volts, 240 volts, 360 volts) or type (e.g., AC or DC). Plugs include standard U.S. electrical plugs and those of any other country, region or jurisdiction. Plugs also means any other type of electrical signal connector or communication connector, such as and without limitation a Universal Serial Bus (USB) plug, serial connection plug, an audio jack, a telephone jack, various video plugs such as HDMI, an Institute of Electrical and Electronic Engineers (IEEE) 1395 (aka "Firewire") plug, a "Thunderbolt" plug or connector, or a standard Internet plug. Similarly, a receptacle is the corresponding connection device or port that connects to a plug. Thus, a receptacle is a connector that connects to the applicable type of plug. Note also that a receptacle is not necessarily a static connector, but rather can be the other end of a power cord or other signal cord that connects or facilitates a connection with the plug. For purposes of the embodiments described below, but without limiting the scope of embodiments of the present invention, the plug described herein is a 120 VAC U.S. standard electric plug and the receptacle is a 120 VAC U.S. standard electrical receptacle.

DETAILED DESCRIPTION

1. Basic Operation and Concept

The following detailed description describes example embodiments of adapters according to the present invention. It is to be understood that the disclosed embodiments are merely exemplary of the invention, which may be embodied in various forms. Therefore, specific structural and functional details disclosed herein are not to be interpreted as limiting, but merely a basis for the claims and as a representative basis for teaching one skilled in the art to variously employ the present invention in any appropriately detailed structure.

Figure 1:
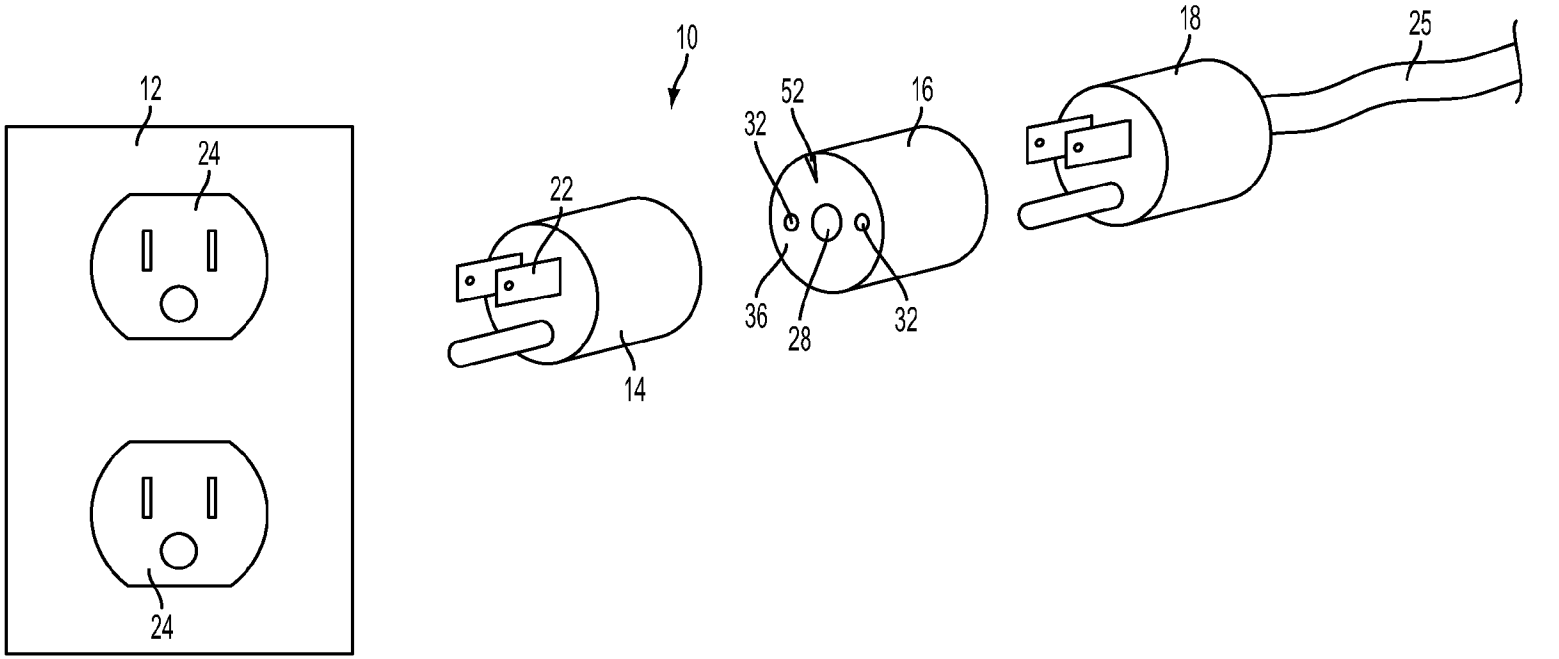
FIG. 1 illustrates a perspective view of an embodiment of an adapter including a receptacle element and plug element.
Figure 2:
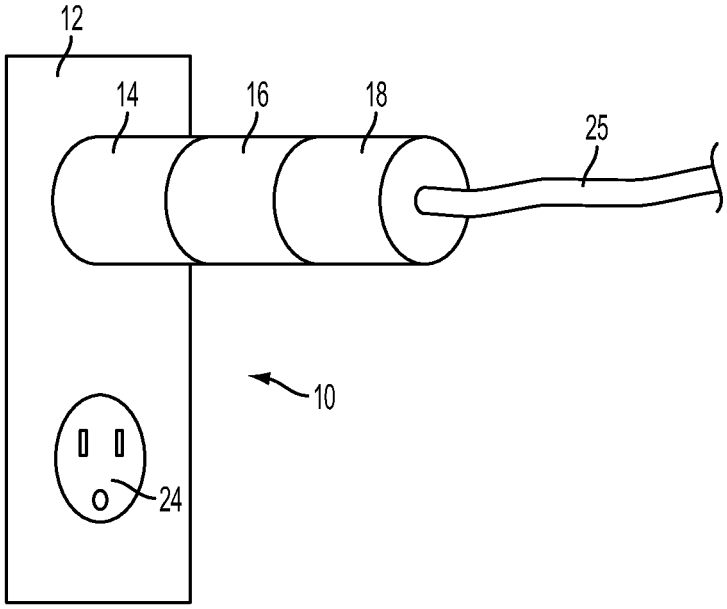
FIG. 2 illustrates a perspective view of an embodiment of an adapter with the plug, plug element, receptacle element, and receptacle electrically connected.
Figure 3:
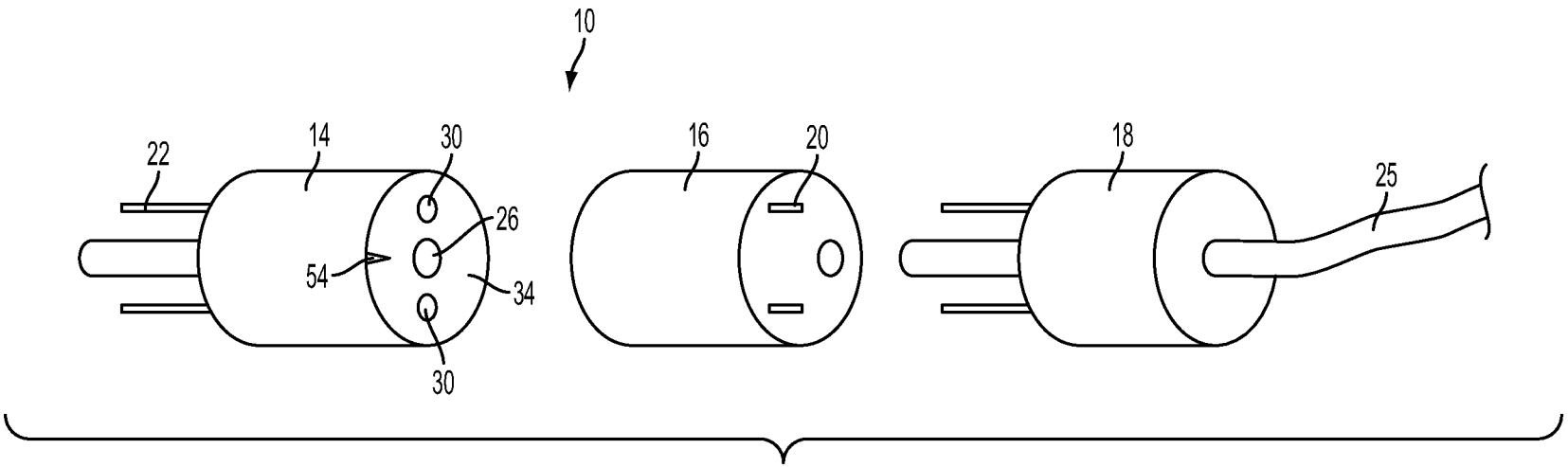
FIG. 3 illustrates a perspective view of an embodiment of an adapter illustrated in FIG. 1 from a different angle.

FIGS. 1, 2, and 3 show an adapter 10 configured in accordance with one example embodiment. The adapter 10 includes a receptacle element 14 and a plug element 16. The receptacle element 14 includes an electrically conductive male connector 22 configured to connect to the receptacle 24 of the outlet 12. The adapter 10 also includes an electrically conductive female connector 20 in the plug element 16 configured for connecting with a plug 18. Plug 18 is electrically connected to power cord 25.

The receptacle element 14 has receptacle side contacts 30 on receptacle face 34. Internal connections, features, mechanisms or devices, examples of which are discussed below, within receptacle element 14 create an electrically conductive path between male connector 22 and receptacle side contacts 30. The plug element 16 has plug side contacts 32 on plug face 36. Internal connections, features, mechanisms or devices, examples of which are discussed below, within plug element 16 create an electrically conductive path between plug side contacts 32 and female connector 20.

To maintain a releasable connection between receptacle element 14 and plug element 16, plug element 16 includes a holding magnet 28. The holding magnet 28 is magnetically attracted to magnet contact 26 included on receptacle element 14. Magnet contact 26 may be a magnet or a magnetically compatible material that attracts to holding magnet 28. The magnetic force between holding magnet 28 and magnet contact 26 is sufficient to maintain a releasable connection between receptacle element 14 and plug element 16.

When the plug element 16 and receptacle element 14 are connected, receptacle side contacts 30 and plug side contacts 32 are in electrical contact and an electrically conductive path is formed between male connector 22 and female connector 20 through adapter 10.

The receptacle 24 is electrically connected to power cord 25 if, as is illustrated in FIG. 2, the receptacle element 14 is connected to the receptacle 24, the receptacle element 14 is connected to the plug element 16, and the plug element 16 is connected to the plug 18. If plug element 16 breaks away from receptacle element 14 then power will not be capable of flowing from receptacle 24 to power cord 25 through adapter 10.

FIGS. 1 and 3 illustrate an embodiment of an adapter 10 where the housing of the receptacle element 14 and the plug element 16 are cylindrical and include a receptacle face 34 and plug face 36 that are round. Alternative shapes and sizes can be used for the housing of the receptacle element 14 and the plug element 16 and their respective faces. For example, the housing of both elements might be cube shaped with square faces for the plug face 36 and receptacle face 34. Other shapes for the housing and faces might be desirable based on the application of the adapter and the configuration of the receptacle and plug.

In the embodiment of an adapter 10 illustrated in FIGS. 1 and 3, the receptacle face 34 and plug face 36 are shown as generally flush. Receptacle side contacts 30 and/or plug side contacts 32 may, for example, protrude slightly to ensure an electrically conductive path is created between them when receptacle face 34 connects with plug face 36.

In certain embodiments of the adapter 10, it may be desirable to align in one or more orientations the receptacle face 34 and plug face 36 so that the receptacle side contacts 30 align with the plug side contacts 32. In the embodiment of the adapter 10 illustrated in FIGS. 1 and 3, receptacle face 34 and plug face 36 each include two contacts for receptacle side contacts 30 and plug side contacts 32 and these contacts are in a linear alignment with magnet contact 26 and holding magnet 28, respectively. Where each contact on a face has a particular contact on the other face it is intended to align with (for example due to polarity of the electrical contacts), only one orientation may be desirable between receptacle face 34 and plug face 36. Accordingly, in the illustrated embodiment of FIGS. 1 and 3, the plug face 36 includes an alignment member 52 that protrudes from the plug face 36. When the plug face 36 is aligned with the receptacle face 34, the alignment member 52 will insert into alignment recess 54 on the receptacle face 34. If plug face 36 is oriented to the receptacle face 34 in any other orientation, the alignment notch 52 would prevent the plug face 36 from properly connecting to the receptacle face 34 and no electrically conductive path would be formed through the adapter 10.

Other features, mechanisms or devices may be used to ensure one or more orientations of alignment of the receptacle element 14 and the plug element 16 enable an electrically conductive path through adapter 10. For example, instead of a circular design of the plug face 36 and receptacle face 34, the faces could be trapezoidal or other shapes that facilitate specific orientations that enable an electrically conductive path through adapter 10. Also, in other embodiments, one or more magnets on receptacle element 14 and plug element 16 could be oriented (including by polarity) such that only the desired orientations between the receptacle element 14 and the plug element 16 enable an electrically conductive path through adapter 10.

In an embodiment of the adapter 10, the housing of the receptacle element 14 and the plug element 16 is comprised of electrically insulating, non-conducting material. Material used as the housing for the plug element 16 or receptacle element 14 might also be comprised of transparent material, at least in part, so as to permit viewing of the internal components of the plug element 16 or receptacle element 14. Such transparency might be desired, for example, to inspect and ensure proper operation of the internal features, mechanisms, or devices of the plug element 16 or receptacle element 14. Also, a light, LED, or other illuminating device or mechanism might be included inside or on the plug element 16 or receptacle element 14.

In the discussion that follows, individual components, features, mechanisms, and devices of an adapter are discussed in further detail. In addition, the discussion that follows describes, without limiting, variations and other configurations and embodiments of an adapter.

2. Magnets

In embodiments of adapter 10, one or more magnets may be used to maintain a releasable connection between the plug element 16 and the receptacle element 14. In embodiments where holding magnet 28 or magnet contact 26 use one or more magnets, the magnets provide an attractive force between the plug element 16 and the receptacle element 14 and can be appropriately sized and oriented to ensure the desired strength of force keeps the receptacle element 14 connected to the plug element 16. Factoring into the selection and arrangement of magnets is the desire that a certain amount of pull on the power cord 25, plug 18, or plug element 16 will separate the plug element 16 from the receptacle element 14 and break the electrical connection between the receptacle 24 and plug 18. The magnet arrangement and strength desired for receptacle element 14 or plug element 16 will depend on factors such as the application of the adapter 10. In settings with heavy plugs or where the adapter 10 is desired to separate only where greater force is applied to the plug element 16, plug 18, or power cord 25, more magnetic force will be necessary to maintain the connection between the plug element 16 and receptacle element 14. In applications with lighter plugs, or where it is desirable to enable the plug element 16 to break away from the receptacle element 14 with less applied force, less magnetic force will be desirable.

Although magnets are referred to in the described embodiments to maintain the releasable connection between the receptacle element 14 and plug element 16, other features, mechanisms and devices can be used together with magnets or in lieu of magnets to maintain the desired releasable connection. References to magnets are not intended to limit the scope of the invention. For example, Velcro, chemical adhesives or friction caused by mechanical "pinching" (e.g., force exerted in a vertical direction where friction prevents movement in a horizontal direction) could be used to maintain the desired releasable connection.

FIGS. 1 and 3 illustrate an embodiment of an adapter 10 with plug element 16 including an at least substantially cylindrical holding magnet 28 with one end of the holding magnet 28 exposed on plug face 36. In this embodiment, the receptacle element 14 has a cylindrical magnet contact 26 positioned with an end of such magnet contact 26 exposed and directly opposite the holding magnet 28 when the receptacle element 14 is aligned and in contact or near contact with plug element 16. In this embodiment, the holding magnet 28 is comprised of a permanent magnet, such as a rare earth magnet, and the magnet contact 26 is comprised of a metal component, such as a ferromagnetic material, that is magnetically compatible with the holding magnet 28. In other embodiments, the magnet contact 26 may also be comprised of a magnet, but with an opposing magnetic polarity of the holding magnet 28 such that the exposed ends of holding magnet 28 and magnet contact 26 have an attractive force between them. In other embodiments, electromagnets may be used in lieu of or in addition to permanent magnets.

Figure 4:
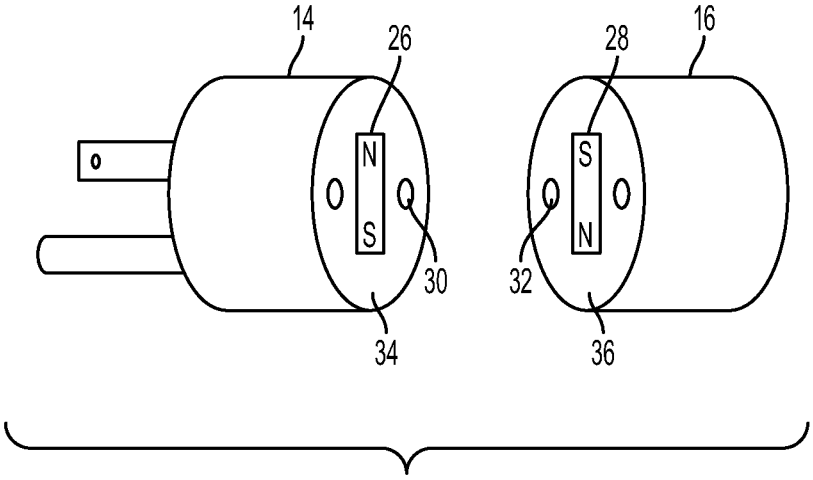
FIG. 4 illustrates a perspective view of an embodiment of an adapter using one or more bar magnets.

FIG. 4 illustrates an embodiment of an adapter 10 where the holding magnet 28 is comprised of a bar magnet. In this illustrated embodiment, the magnet contact 26 is also comprised of a bar magnet. The bar magnets used in this embodiment are polarized, each having a north and south end. An attractive force exists between the north ends of the magnets and the south ends of the magnets. A repulsive force exists between the north end of one magnet and the north end of the other magnet, as well as the south end of one magnet and the south end of the other magnet. Accordingly, when the receptacle face 34 is positioned adjacent to the plug face 36, the orientation where the north and south poles are opposite one another will cause an attractive force between the receptacle face 34 and the plug face 36. On the other hand, the opposite orientation where the north poles of the magnets are opposite each other and where the south poles are opposite each other will cause a repulsive force between the receptacle face 34 and the plug face 36. This arrangement can be advantageous where a single orientation is desired between the receptacle face 34 and plug face 36, and illustrates an embodiment where magnets can be used to create the desired orientation between the receptacle face 34 and plug face 36.

Figure 5:
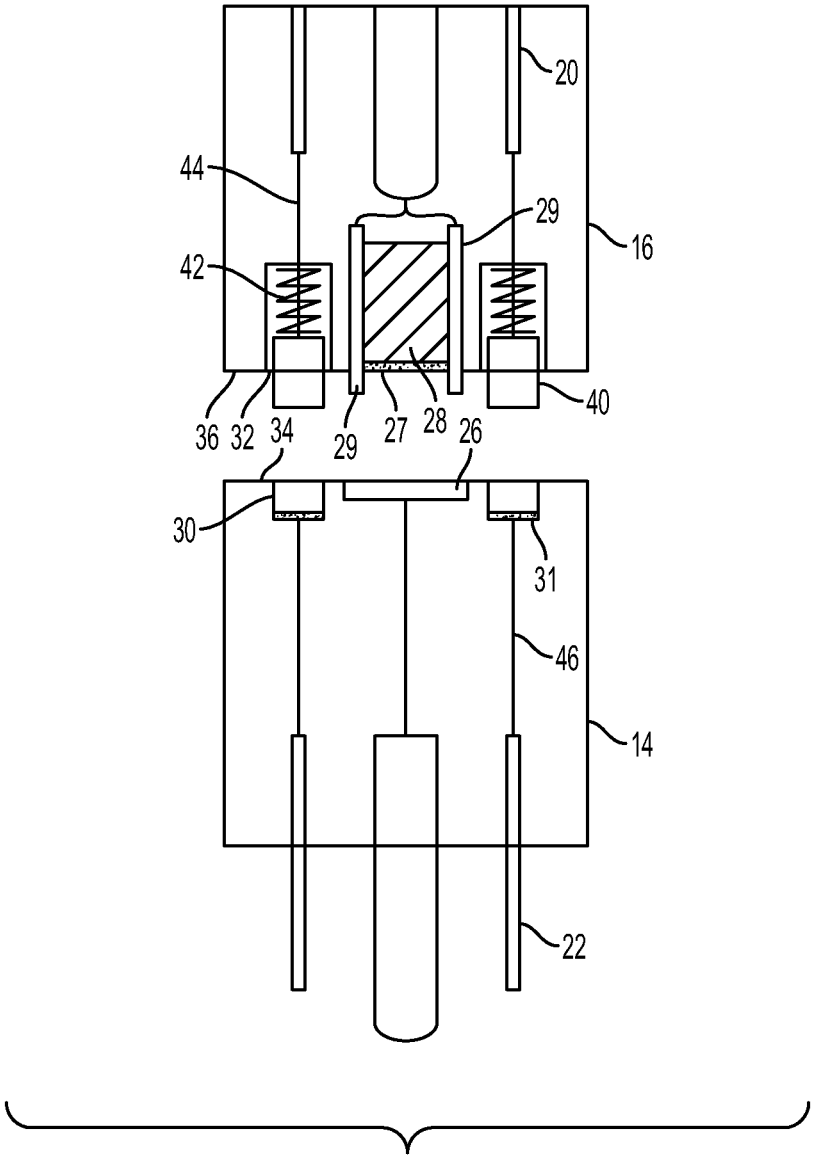
FIG. 5 illustrates a cross-sectional view of an embodiment of an adapter including protruding conductive arms and pins.

FIG. 5 illustrates an embodiment of an adapter 10 including conductive arms 29 positioned on opposing sides of holding magnet 28 within plug element 16. The conductive arms 29 of the illustrated embodiment are magnetically conductive metal plates. Alternative shapes can be used in place of plates. In the illustrated embodiment, the conductive arms 29 protrude slightly from plug face 36 while holding magnet 28 is embedded within plug element 16 behind magnet retainer 27. Holding magnet 28 magnetizes the conductive arms 29, and, when placed in the proximity of magnet contact 26, which may be a magnet or a magnetically compatible material, creates an attractive force between plug element 16 and receptacle element 14. Using conductive arms 29 with holding magnet 28 embedded within plug element 14 can be beneficial in applications where it is difficult to attach holding magnet 28 to be flush with plug face 36 or otherwise exposed on plug face 36. In an alternative embodiment, the conductive arms and magnet are included in receptacle element 14 while plug element 16 includes a magnet or a magnetically compatible material.

A number of other embodiments having various types, shapes, and arrangements of magnets can be used in an adapter 10 to facilitate a releasable connection between the receptacle element 14 and plug element 16. In addition to the embodiments described above, one or more magnet pairs (either combinations of magnets or a combination of magnets and magnetically compatible material) may be positioned along the circumference of the plug face 36 and receptacle face 34. Also, instead of including the magnet on the plug element 16, the magnet may be included on the receptacle element 14 such that in the embodiment illustrated in FIGS. 1 and 3, magnet contact 26 may be a magnet and the holding magnet 28 may instead be a metal part, such as a ferromagnetic material. In addition, it may be desirable to use multiple magnet pairs or to place the magnet pair in locations other than in the center of the receptacle face 34 and plug face 36.

3. Pins and Contacts

The receptacle side contacts 30 and plug side contacts 32 are capable of differing designs and configurations. In alternative embodiments, the plug side contacts 32 and receptacle side contacts 30 could be pins, wires, plates, brackets, metal clips or other suitable features, mechanisms or devices for creating a conductive path between the plug element 16 and receptacle element 14 when the plug face 36 is engaged with or adjacent to receptacle face 34.

FIG. 5 illustrates a cross-sectional view of an adapter 10 including spring-loaded pins. In the illustrated embodiment, plug side contacts 32 of the plug element 16 are comprised of electrically conductive spring-loaded pins 40 and the receptacle side contacts 30 of the receptacle element 14 are comprised of electrically conductive flat plates. Spring-loaded pins advantageously enable a solid contact with the receptacle side contacts 30. The plug side contacts 32 include pins 40 and springs 42. The springs 42 bias the pins 40 to protrude from plug face 36 and towards the receptacle element 14 and enable a better contact with the receptacle side contacts 30 of the receptacle element 14 when the plug face 36 is engaged with the receptacle face 34. The springs 42 of the plug side contacts 32 of the illustrated embodiment are located behind the pins 40 and inside plug element 16. Each plug side contact 32, including pins 40, is electrically connected to female connector 20 by plug wires 44. Other features, mechanisms or devices may be used to bias pins 40 towards the receptacle side contacts 30 of the receptacle element 14. The receptacle side contacts 30 may be comprised of electrically conductive plates 31 that have a slight depression to maximize surface contact with pins 40. In the illustrated embodiment in FIG. 5, the plates 31 are recessed in a hole and located below the surface of receptacle face 34 such that they are not flush with the receptacle face 34 and are accessible by pins 40 through a hole slightly larger in diameter than pins 40. Locating plates 31 within receptacle element 14 and below the surface of receptacle face 34 may be desirable to reduce the occurrence of electrocution caused by touching plates 31 when the receptacle element is handled, particularly when plug element 16 is separated from receptacle element 14. The holes through which plates 31 are accessible, including the corresponding pins 40, may be sized so it is difficult to touch plates 31 for even people with small fingers or common metal objects. Receptacle wires 46 electrically connect receptacle side contacts 30, including plates 31, with male connector 22. In alternative embodiments, instead of being located on the plug element 16, the spring-loaded pins or other suitable contacts could be located on the receptacle element 14, with plates included with plug element 16.

Figure 6:
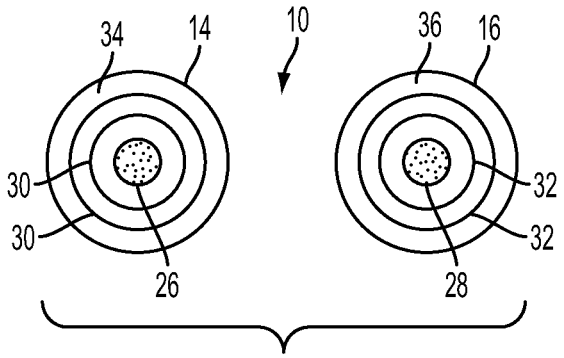

FIGS. 6, 7, 8, 9, 10, and 11 illustrate examples of different configurations of the contacts and magnets on the receptacle face 34 and plug face 36. FIG. 6 illustrates an embodiment of an adapter 10 comprised of a pair of receptacle side contacts 30 on receptacle face 34 and a pair of matching plug side contacts 32 on plug face 36. In this embodiment, the contacts form concentric rings thus allowing the plug element 16 and receptacle element 14 to be connected in 360 degrees of orientation. In this embodiment, the holding magnet 28 is shown in the center of plug face 36 and magnet contact 26 is in the center of receptacle face 34. In alternative embodiments, other locations and quantities of magnets and magnet contacts might be used. For example, in an alternative embodiment that is not shown, the holding magnet 28 might be a ring magnet that is concentric with the plug side contacts 32, and magnet contact 26 would have a matching or appropriate shape and location on receptacle face 34.

Figure 7:
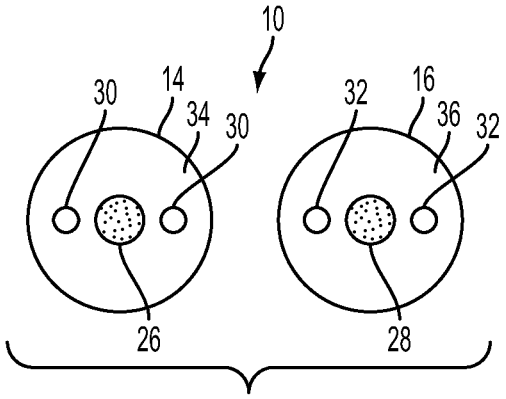
Figure 8:
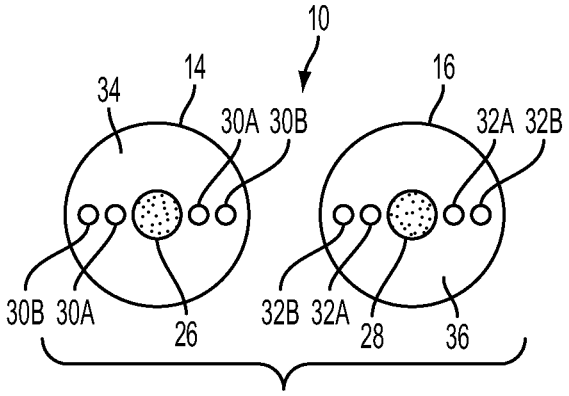

FIGS. 7 and 8 illustrate an embodiment of an adapter 10 comprised of receptacle side contacts 30 and plug side contacts 32 having a linear orientation with the magnet contact 26 and holding magnet 28, respectively. In FIG. 7, if the contacts have opposite polarities, then such a configuration is capable of one orientation between the plug element 16 and the receptacle element 14. FIG. 8 shows an embodiment where the receptacle side contacts 30 and plug side contacts 32 also have a linear orientation with the magnet contact 26 and holding magnet 28, respectively. This configuration, however, is capable of at least two orientations if the contacts closer to the center of the receptacle face 34 and plug face 36, designated 30A and 32A, respectively, are of one polarity and the contacts farther away from the center of the receptacle face 34 and plug face 36, designated 30B and 32B, respectively, are of another or opposite polarity.

Figure 9:
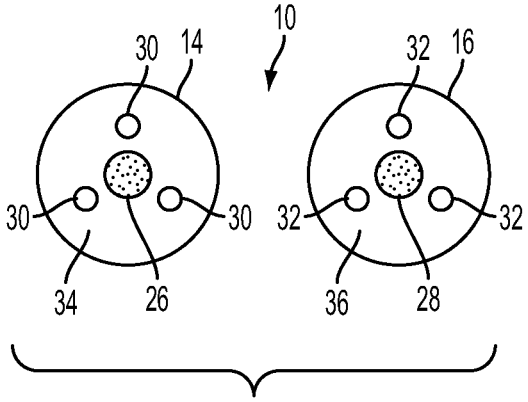

FIG. 9 illustrates an embodiment of an adapter 10 comprised of three receptacle side contacts 30 and three matching plug side contacts 32. This embodiment further includes a holding magnet 28 and magnet contact 26 in the center of plug face 36 and receptacle face 34, respectively. Three contacts might be desired, for example, where one of the contacts is a ground and the other two contacts are the neutral and "hot" electrical paths. This figure also illustrates an embodiment capable of just one orientation between the plug element 16 and the receptacle element 14.

If a ground path or three or more paths are required for a given embodiment, an additional receptacle side contact 30 and plug side contact 32 could be added to any of the embodiments described above. For example, a ground could be added to the embodiment illustrated in FIG. 6 by adding an additional concentric ring on both the plug face 36 and receptacle face 34 or by designing the holding magnet 28 and magnet contact 26 to be electrically conductive and thus capable of serving as a path for the ground or the neutral or "hot" electrical paths. This alternative to the embodiment illustrated in FIG. 6 would thus still be capable of 360 degrees of orientation. Also, in the embodiment illustrated in FIG. 5, conductive arms 29 could be configured to be a path such as the ground or the neutral or "hot" electrical paths.

Figure 10:
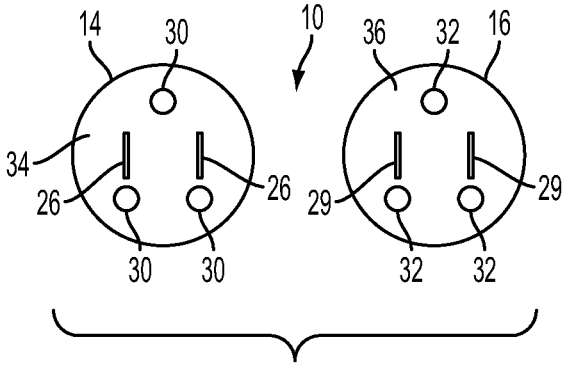

FIG. 10 illustrates an embodiment of an adapter 10 that is similar to the embodiment illustrated in FIG. 5 including conductive arms 29. In the illustrated embodiment, magnetically conductive arms 29 protrude from plug face 36. Receptacle face 34 includes magnet contacts 26 positioned to be opposite conductive arms 29 when plug face 36 is positioned to connect with receptacle face 34. Magnet contacts 26 may include multiple magnetically conductive magnet contacts 26 (as shown) or a single piece of magnetically conductive material comprising magnet contacts 26.

Figure 11:
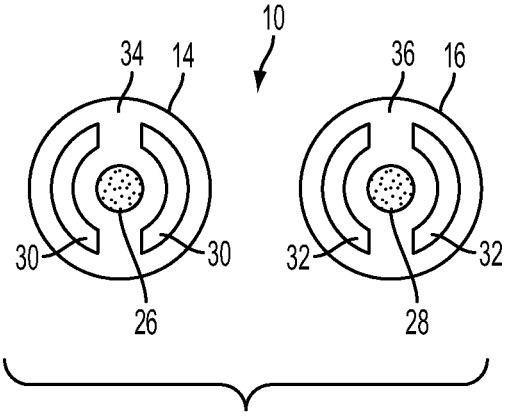

FIG. 11 illustrates yet another possible embodiment of an adapter 10 including receptacle side contacts 30 and plug side contacts 32 that are in the shape of arcs. This embodiment further includes a holding magnet 28 and magnet contact 26 in the center of plug face 36 and receptacle face 34, respectively. As noted above, the holding magnet 28 and magnet contact 26 may also form paths for the ground, neutral or hot electrical paths.

Many alternative shapes and embodiments can be devised to make an adapter suitable for a desired application. The foregoing are merely examples of embodiments showing how the contacts and magnets may be arranged to meet desired characteristics for an application of an adapter. In the embodiments described above, one or more additional contacts might be added for one or more signal paths, ground, additional power connections (e.g., to handle three phase power) or for other desirable electrical communication purposes, such as to communicate an electrical fault or compatibility (or lack thereof) with a connected device. Also, as noted, where an adapter is used for communication, multiple paths, and therefore multiple contacts, may be required.

4. Safety Features

FIGS. 12 and 13 illustrate an embodiment of an adapter 10 having a mechanism to safely disable or "de-energize" (that is, electric current will not flow) receptacle side contacts 30 when the plug element 16 is not connected to the receptacle element 14. FIG. 12 illustrates a cross-sectional view of an adapter 10 with the receptacle element 14 separated from the plug element 16. FIG. 13 shows the embodiment illustrated in FIG. 12 except with the receptacle element 14 connected to the plug element 16.

The receptacle element 14 in the illustrated embodiment of FIGS. 12 and 13 includes a magnetic piston switch 59 that cycles between a state of having receptacle side contacts 30 energized when the plug element 16 is connected to receptacle element 14 (shown in FIG. 13), and de-energized when the plug element 16 is not connected to the receptacle element 14 (shown in FIG. 12).

The receptacle element 14 of the illustrated embodiment includes a conducting plate 60 located on the receptacle face 34 and located to connect with holding magnet 28 when the receptacle element 14 connects with plug element 16. The conducting plate 60 of the illustrated embodiment is thin and electrically and magnetically conductive. Also, the conducting plate 60 of this embodiment is flush with the receptacle face 34. Behind the conducting plate 60 is an at least substantially cylindrically shaped piston chamber 61.

Within the piston chamber 61 is a matching piston cylinder 62 of a Ferro-magnetic material that is sized and fitted to slide towards and away from conducting plate 60. Piston cylinder 62 is connected to rod 64. Rod 64 slides through the hole 63 at the end of the piston chamber 61. At the other end of rod 64 is a contact arm 68. At the ends of contact arm 68 are electrical contacts 70 positioned opposite receiving contacts 72. Positioned around rod 64 is piston spring 66. The electrical contacts 70 are electrically connected to male connector 22 and maintain such electrical connection regardless of their position. The receiving contacts 72 are electrically connected to receptacle side contacts 30. Thus, when electrical contacts 70 are connected to receiving contacts 72, there is an electrically conductive path (that is, current will flow) between male connector 22 and receptacle side contacts 30.

The force from piston spring 66 bias piston cylinder 62, rod 64 and contact arm 68 away from receptacle face 34. When plug element 16 is separated from receptacle element 14, no counter-force is exerted on piston cylinder 62, rod 64 or contact arm 68, causing the same to move away from receptacle face 34. This movement slides electrical contacts 70 away from receiving contacts 72 such that no electrical connection exists between electrical contacts 70 and receiving contacts 72. Thus, if receptacle element 14 was plugged into an energized receptacle 24, such as the receptacle shown in FIG. 1, and plug element 16 was not engaged with receptacle element 14, receiving contacts 72 would not be energized and receptacle side contacts 30 would likewise not be energized. Thus, the piston spring 66 causes magnetic piston switch 59 to be a "normally open" switch. In an alternative embodiment, a second magnet 74 might be located at the end of piston chamber 61 opposite conducting plate 60. Second magnet 74 and piston spring 66 may be used separately where only one of the two is used in an adapter 10 or together to complement the force each provides. Second magnet 74 is oriented to magnetically attract piston cylinder 62 thus providing force in the same direction as piston spring 66 and thereby biasing piston cylinder 62, rod 64 and contact arm 68 away from receptacle face 34. When plug element 16 is not engaged with receptacle element 14, second magnet 74, alone or when combined with piston spring 66, maintain magnet piston switch 59 in an open position.

Holding magnet 28 also magnetically attracts piston cylinder 62, but in a direction opposite the force exerted by piston spring 66 and second magnet 74. The force exerted by holding magnet 28 on piston cylinder 62 is greater than the force of piston spring 66 or second magnet 74, alone and when combined. If plug element 16 is connected to receptacle element 14 such that their faces are properly aligned, then magnetic force from holding magnet 28 causes piston cylinder 62 to move towards holding magnet 28. The magnetic force from holding magnet 28 is sufficient to maintain a releasable connection between the receptacle element 14 and plug element 16. As the piston cylinder 62 moves towards and touches conducting plate 60, rod 64 and contact arm 68 also move causing electrical contacts 70 to electrically engage receiving contacts 72. When electrical contacts 70 engage receiving contacts 72, an electrically conductive path is created between male connector 22 and receptacle side contacts 30 and plug side contacts 32. Thus, if receptacle element 14 was plugged into an energized receptacle 24, such as the receptacle shown in FIG. 1, and plug element 16 was engaged with receptacle element 14, receiving contacts 72 would be energized and receptacle side contacts 30 and plug side contacts 32 would likewise be energized. Since plug side contacts 32 are electrically connected with female connector 20, female connector 20 would also be energized.

In embodiments of the adapter intended for use with three-phase power (not shown) or additional contacts, the magnetic piston switch 59 could have three or more electrical contacts 70 for energizing and de-energizing the receptacle side contacts 30.

An alternative embodiment of adapter 10, illustrated in FIGS. 14, 15, 16, 17, and 18, adapter 10 includes features, mechanisms or devices to prevent accidental contact to receptacle side contacts 30 when plug element 14 is not connected to receptacle element 16.

Figure 14:
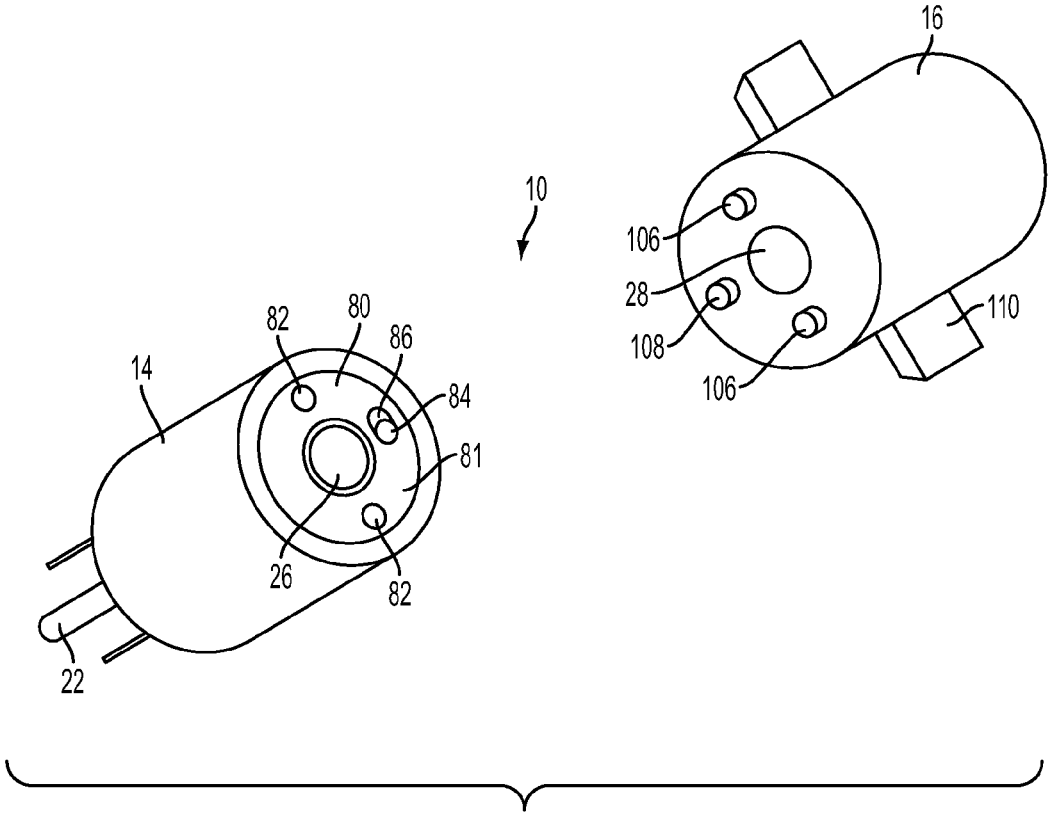

As shown in FIG. 14, receptacle element 14 includes guard 80. As further described below, guard 80 operates to cover receptacle side contacts 30 of receptacle element 14 when plug element 16 is disengaged from plug element 14. When guard 80 is rotated, such as occurs when plug element 16 is connected to receptacle element 14, receptacle side contacts 30 are then exposed to a limited extent sufficient to enable a contact between receptacle side contacts 30 and plug side contacts 32. In the illustrated embodiment, for plug side contacts 32 to connect with receptacle side contacts 30, plug side contacts 32 extend into receptacle element 14 to reach and form an electrically conductive path with receptacle side contacts 30. Thus, when guard 80 is rotated to expose receptacle side contacts 30, the receptacle side contacts 30 are not readily reached thus providing additional protection against accidental touching and electrocution, even when the receptacle side contacts 30 are exposed by rotating guard 80.

Figure 15:
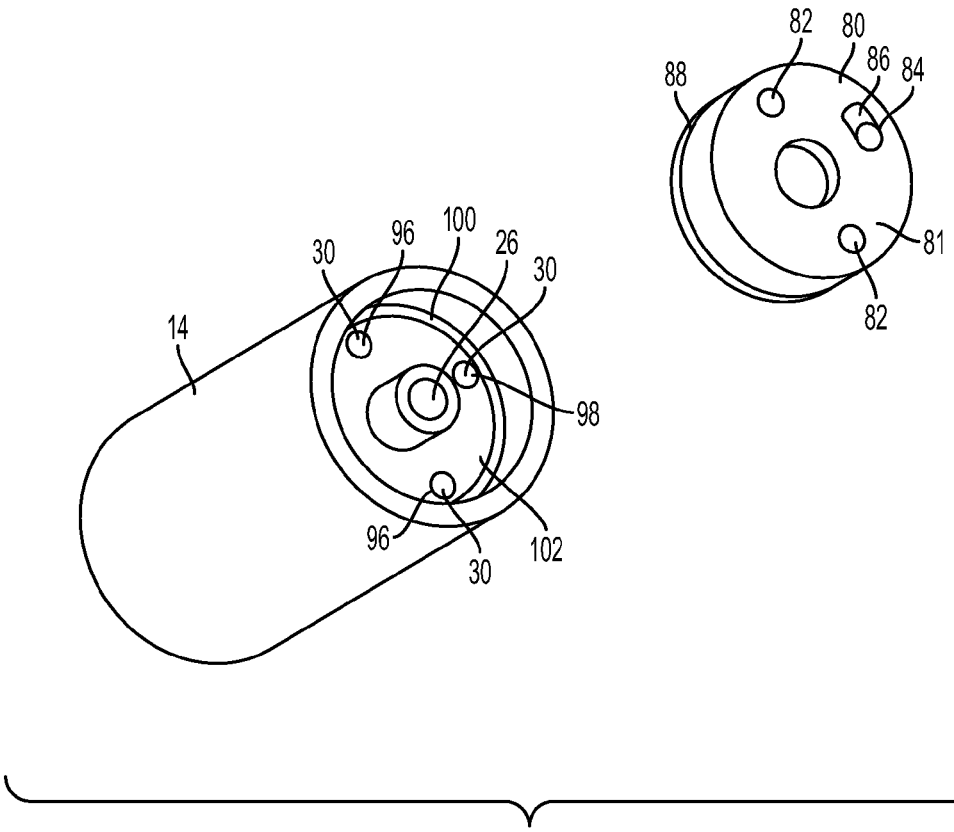

FIG. 15 shows receptacle element 14 with guard 80 removed for illustration and description purposes. In the illustrated embodiment, guard 80 is cylindrical with a guard surface 81 and slots in guard surface 81 comprised of key slots 82 and hot slot 84. An assembled receptacle element 14 includes guard 80 as illustrated in FIG. 14 with guard surface 81 exposed for contact with plug element 16. Guard 80 includes a rib 88 around the base of guard 80. Receptacle element 14 includes rib channel 100 positioned to receive rib 88 to retain guard 80 in receptacle element 14. Rib 88 and rib channel 100 are sized to permit guard 80 to rotate, while retaining guard 80 within receptacle element 14 as illustrated.

Figure 16:
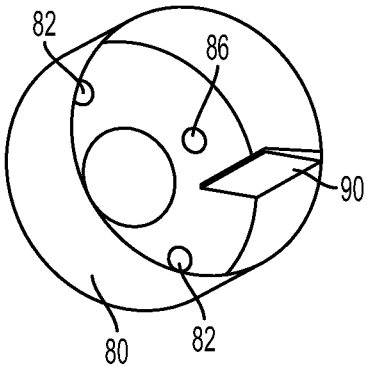
Figure 17:
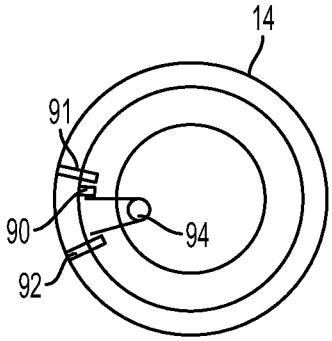

FIG. 16 shows the underside of guard 80, relative to the view shown in FIG. 15. As shown in FIG. 16, guard 80 includes guard fin 90 located inside guard 80. FIG. 17 shows a cross sectional view of receptacle element 14 including guard 80. As shown in FIG. 17, receptacle element 14 includes guard fin 90 and receptacle fin 92. The illustrated embodiment also includes rotation spring 94. In the illustrated embodiment, rotation spring 94 is a torsion spring. Rotation spring 94 is positioned within receptacle element 14 to contact guard fin 90 and receptacle fin 92. This arrangement causes the rotational spring 94 to create a resistive force when guard fin 90 and receptacle fin 92 are rotated towards one another. Rotation stopper 91 is positioned to prevent guard 80 from rotating beyond a certain distance in a direction away from receptacle fin 92. When no other rotational force is exerted on guard 80 or receptacle element 14, force from rotation spring 94 causes guard fin 90 to be adjacent to and in contact with rotational stopper 91. When rotational force is applied to guard 80 in a direction towards receptacle fin 92, guard fin 90 will move towards receptacle fin 92. Receptacle fin 92 prevents guard fin 90 from moving further in that direction. Thus, guard fin 90 is capable of rotationally moving between rotation stopper 91 and receptacle fin 92. Because guard fin 90 is connected to guard 80, guard 80 has a similar rotational limitation. When guard 80 is in the position where guard fin 90 is in contact with rotation stopper 91, receptacle side contacts 30 would be covered by guard 80. When guard 80 is rotated to a position where guard fin 90 is closer to or in contact with receptacle fin 92, receptacle side contacts 30 would be exposed and uncovered by guard 80.

Referring again to FIG. 14, plug side contacts 32 are comprised of keys 106 and hot contact 108. When the plug element 16 is connected to the receptacle element 14, keys 106 make an electrical connection with either the neutral or ground contacts of the receptacle side contacts 30, and hot contact 108 makes an electrical connection with the hot contact of the receptacle side contacts 30. In the illustrated embodiment, keys 106 are in a linear arrangement with holding magnet 28. Hot contact 108 is located ninety degrees from keys 106. Like plug element 16, guard 80 of receptacle element 14 includes key slots 82 located in a linear arrangement with magnet contact 26. Also, guard 80 includes hot slot 84 located ninety degrees from key slots 84. Key slots 82 and hot slot 84 are located and sized to receive keys 106 and hot contact 108, respectively.

As illustrated in FIG. 15, receptacle element 14 includes in a position to be immediately underneath guard surface 81 a lower surface 102. Lower surface 102 includes contact slots 96 and receptacle hot slot 98. Contact slots 96 are in a linear arrangement with magnet contact 26. Receptacle hot slot 98 is located ninety degrees from contact slots 96. When guard 80 is positioned with guard fin 90 in contact with rotation stopper 91, contact slots 96 and key slots 82 are not in alignment, and hot slot 84 and receptacle hot slot 98 are also not in alignment. When guard 80 is rotated, at a designated location where guard fin 90 is in contact or near contact with receptacle fin 92, key slots 82 align with contact slots 96, and hot slot 84 aligns with receptacle hot slot 98.

To connect plug element 16 to receptacle element 14 and create an electrically conductive path between receptacle element 14 and plug element 14, keys 106 and hot contact 108 are positioned opposite key slots 82 and hot slot 84, respectively. Keys 106 and hot contact 108 are then inserted into key slots 82 and hot slot 84. Once inserted, lower surface 102 limits further insertion into receptacle element 14. In this position, there is no electrical connectivity between receptacle element 14 and plug element 16.

As shown in FIG. 14, plug element 16 includes lever 110. Lever 110 is capable of moving either towards or away from plug face 36 within a channel in plug element 16. Lever 110 is slideably connected to plug side contacts 32 such that sliding lever 110 towards plug face 36 extends plug side contacts 32 from plug face 36, and sliding lever 110 away from plug face 36 causes plug side contacts 32 to retract into plug element 16. When plug element 16 is connected to receptacle element 14, lever 110 is located in a position farthest away from plug face 36 and plug side contacts 32 are in their most retracted position. When plug side contacts 32 are in their most retracted position, plug side contacts 32 extend from plug face 36 by a distance that is approximately the depth of key slots 82 and hot slot 84.

As an additional safety feature, guard 80 may include slope 86 positioned adjacent to hot slot 84. Slope 86 is included on the side of hot slot 84 in the direction guard 80 rotates when rotation spring 94 is compressed. Slope 86 extends from the bottom of guard surface 81 (i.e., the depth of guard 80) to the top of guard surface 81. Unlike the vertical walls of key slots 82 that provide a surface for keys 106 to exert force on, the angled wall of slope 86 of hot slot 84 is more difficult for an object to grip to use hot slot 84 to rotate guard 80. Thus, slope 86 is advantageous as a safety feature when a hard, electrically conductive object, such as a pair of scissors, are inserted into hot slot 84 and used alone to attempt to rotate guard 80 to expose receptacle side contacts 30. Slope 86 is most beneficial where the contact exposed by the slot is a "hot" contact.

With keys 106 and hot contact 108 inserted into key slots 82 and hot slot 84, lever 110, and accordingly plug element 16, are then rotated in a direction that compresses rotation spring 94 as guard fin 90 moves towards receptacle fin 92. Movement of lever 110 in the opposite direction is prevented by rotation stopper 91. As lever 110 rotates, keys 106 push against the side of key slots 82 causing guard 80 to rotate as well. Lever 110 is rotated until contact slots 96 and receptacle hot slot 98 are exposed and keys 106 and hot contact 108 are capable of penetrating lower surface 102 to reach the receptacle side contacts 30. Lever 110 is then pushed further towards plug face 36 to further extend keys 106 and hot contact 108 to make a connection with receptacle side contacts 30. With Keys 106 and hot contact 108 in contact with receptacle side contacts 30, an electrical connection is established between receptacle element 14 and plug element 16.

Figure 18:
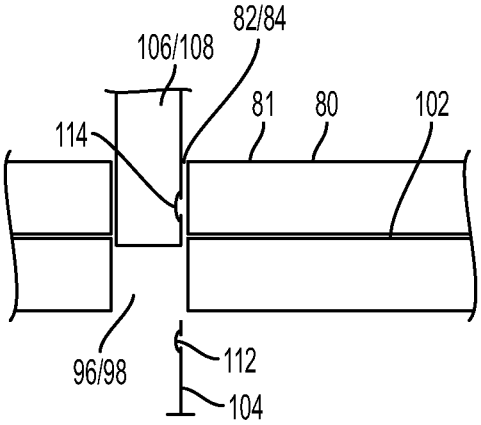

FIG. 18 illustrates a cross section of an aligned key slot 82 and contact slot 96 pair, or alternatively, an aligned hot slot 84 and receptacle hot slot 98 pair. When the pairs are in alignment, receptacle side contacts 30, comprised of contact clips 104, are exposed and can be contacted by plug side contacts 32, comprised of keys 106 and hot contact 108. As lever 110 is moved towards plug face 36 to extend plug side contacts 32 further into receptacle element 14 to contact receptacle side contacts 30, contact clips 104 become electrically connected to keys 106 and hot contact 108. Contact clips 104 for the contact slots 96 are connected to the neutral and ground of male connector 22 (not shown). Contact clips 104 for the receptacle hot slot 98 is connected to the hot of male connector 22 (not shown). In the illustrated embodiment, contact clips 104 include a protruding bump 112 that helps retain plug side contacts 32 by providing retention force at receiving channels 114 of plug side contacts 32.

When a force causes plug element 16 to disconnect from receptacle element 14, and extracts keys 106 and hot contact 108 from key slots 82 and hot slot 84, respectively, rotation spring 94 forces guard fin 90 away from receptacle fin 92 and thus rotates guard 80 back to a position where key slots 82 and hot slot 84 are no longer in alignment with contact slots 96 and receptacle hot slot 98, respectively. Thus, when the plug element 16 is disconnected from receptacle element 14, guard 80 covers receptacle side contacts 30.

In other embodiments of the embodiment described above, rotation spring 94 is a compression spring or other spring design or device that causes the described rotational force.

Other features, mechanisms and devices can be included in alternative embodiments of an adapter to de-energize receptacle side contacts 30 when the receptacle element 14 is disengaged and no longer in contact with the plug element 16, or to prevent the receptacle side contacts 30 from being exposed when the receptacle element 14 is disengaged and no longer in contact with the plug element 14.

For example, in an alternative embodiment of an adapter 10 illustrated in FIG. 19, a proximity sensor and switch 76 may be incorporated into receptacle element 14. The proximity sensor and switch 76 of the illustrated embodiment is a normally open switch that uses a hall effect sensor, a reed switch or other suitable switches to close the switch and energize the receptacle side contacts 30 (including the "hot" or possibly the neutral and ground in addition) when the holding magnet 28 of the plug element 16 (such as the plug element illustrated in FIG. 1) is in close proximity to the proximity sensor and switch 76. When the holding magnet 28 is removed from the proximity of the proximity sensor and switch 76, the switch opens and the receptacle side contacts 30 are no longer energized. In alternative embodiments, other types of sensors and switches, electrical, mechanical and otherwise, can be incorporated to disable the receptacle side contacts 30 when the plug element 16 is not in close proximity to the receptacle element 14. In addition, it may be desirable for the receptacle side contacts 30 to be energized only when a unique or preferred plug element 16 is in close proximity with the receptacle element 14. In these instances, an RFID tag (radio frequency identification) or similar identification device can be included with the plug element 16, and a sensor and switch is included with the receptacle element 14 that is capable of sensing the RFID tag and identifying that the tag corresponds to a preferred plug element 16.

The safety features described above may be configured to be redundant with multiple safety features included in the adapter 10. In this way, if one safety feature fails, the other safety feature(s) may still render the receptacle side contacts 30 de-energized if plug element 16 is not engaged with receptacle element 14 or may render the receptacle side contacts 30 covered and unexposed.

5. Energized Indicator Light

As an additional safety measure, an embodiment of an adapter 10, such as the adapter 10 illustrated in FIGS. 12 and 13, includes an indicator light 116 that is illuminated when a receptacle side contact 30 is energized, the magnet piston switch 59 or other safety mechanism has a closed switch, or when current is flowing. Thus, if the indicator light 116 were illuminated, a person would be alerted that the receptacle side contacts 30 are "hot" or energized and would be dangerous to touch. Further, the indicator light 116 might be used to indicate a malfunction or improper operation of the receptacle element 14 as would be the case if the plug element 16 is not connected to the receptacle element 14 and the indicator light 116 is illuminated. The energized indicator light 116 may also be configured to show when energy is being consumed by a devices connected to the adapter 10 by plug 18. In this way, the indicator light 116 may be configured to illuminate when power is being consumed through adapter 10 and therefore advantageously show power consumption when a person might be unaware that a device is consuming power.

6. Orientation

FIG. 20 illustrates an alternative embodiment of an adapter 10 showing on receptacle element 14 a lip 120 around the circumference of receptacle face 34. A matching lip receiver 122 is shown around the circumference of plug face 36. The lip 120 preferably fits over the lip receiver 122 such that when the receptacle face 34 and plug face 36 are in proper alignment, the receptacle face 34 and plug face 36 are in contact and a suitable electrically conductive connection is made between the plug side contacts 32 and receptacle side contacts 30. The pairing of the lip 120 and lip receiver 122 reduces undesirable sliding and assists with aligning plug element 16 with receptacle element 14 when making a connection.

In alternative embodiments of the adapter 10, the lip 120 may be located on plug element 16 and lip receiver 122 may be located on receptacle element 14. In another alternative embodiment of the adapter 10, the lip 120 and lip receiver 122 are combined with an alignment notch 52 (illustrated in FIG. 1) and alignment recess 54, discussed above, to advantageously enhance the preferred alignment between plug element 16 and receptacle element 14.

7. Plug Element Hard Wired to Power Cord

FIG. 21 illustrates an alternative embodiment of an adapter 10 in which plug element 16 is connected directly to power cord 25. Unlike embodiments shown above, the plug 18 shown in previous embodiments has been removed and the electrical wires in power cord 25 are wired directly into plug element 16. This design is advantageous for devices where it is desirable to use the advantages of the embodiments described above to directly attach power cord 25 to the plug element 16. In all other respects, the plug element 16 of this embodiment is substantially identical to the embodiments discussed elsewhere and can take advantage of the variations of the embodiments disclosed herein. This embodiment might be used, for example, in TV or computer power cords such that the plug element 16 is directly wired to such TV or computer power cords.

8. Non-static Receptacle

In embodiments discussed above, receptacle 24 is described and shown as part of outlet 12, where outlet 12 is, for purposes of the embodiments described herein, but without limiting the scope of the application of the present invention, generally a standard electrical outlet attached to a wall or other static mount, such as a mount on an electrical appliance. In an alternative embodiment of the adapter 10 illustrated in FIG. 22, receptacle 24 is not statically mounted. In this illustrated embodiment, receptacle 24 is a receptacle of a second power cord 130 or other non-static electrical connector. As shown in FIG. 22, plug 18 and receptacle 24 are ends of power cord 25 and second power cord 130, respectively. In this embodiment, adapter 10 enables a releasable connection between plug 18 and receptacle 24 thus reducing the likelihood of damage to plug 18 or receptacle 24 if force is exerted on either or both of them. Thus, if a person were to trip on either power cord 25 or second power cord 130, the connection between the plug element 16 and receptacle element 14 would release thus reducing the likelihood that the person would trip and harm his or her self or that damage would result to the plug 18, receptacle 24, or any device or item connected to the other ends of the power cord 25 or second power cord 130.

9. Receptacle and Receptacle Element as a Single Piece

In embodiments discussed above, receptacle 24 and receptacle element 14 are described as two distinct components. In particular embodiments, receptacle 24 and receptacle element 14 form a single piece, which may, for example, be incorporated as part of a statically mounted wall outlet. This design is advantageous for attaching devices (e.g., devices with plug elements 16 attached directly to power cord 25) directly to power outlets without the need for a separate receptacle element 14. In all other respects, the receptacle 24 and receptacle element 14 of this embodiment are substantially identical to the embodiment discussed elsewhere and can take advantage of the variations of the embodiments disclosed herein. This embodiment might be used, for example, in place of or in addition to traditional power outlets in a home.

10. Plug Element Hard Wired to Power Cord and Receptacle and Receptacle Element as a Single Piece In particular embodiments, the plug element 16 is directly connected to the power cord 25 as discussed in section 7 above, and the receptacle 24 and receptacle element 14 form a single piece as discussed in section 9 above. This design is advantageous for attaching devices directly to power outlets with the same safety and quick disconnect features discussed above without the need for additional plug elements, receptacle elements, or additional adapters. In all other respects, the plug element 16, receptacle 24 and receptacle element 14 of this embodiment are substantially identical to the embodiments discussed elsewhere and can take advantage of the variations of the embodiments disclosed herein.

11. Hinged Contact Points

FIGS. 23-26 show yet another embodiment of the present invention. As may be understood from these figures, in this embodiment a quick disconnect power adapter comprises a receptacle element 14, a plug element 16, and a plug 18. As shown in FIG. 23, the receptacle element 14 defines three contact receptacles 232 and a magnet receptacle 234 on the receptacle element's outer face. As shown in FIG. 24, the plug element 16 comprises three contacts 228 and a magnet portion 226 on the plug element's outer face that substantially correspond in size, shape, and orientation to the receptacle element's respective contact receptacles 232 and magnet receptacle 234.

FIG. 25 is a cross-sectional view of the receptacle element 14 and plug element 16. As shown in FIG. 25, the receptacle element 14 comprises a hinged element 248 in the receptacle element's interior portion. In the embodiment shown in this figure, the hinged element 248 comprises two contacts 246 that generally correspond to the receptacle element's upper two contact receptacles 232. The hinged element 248 further comprises a magnet 244. In particular embodiments, the magnet 244 may comprise any magnetic material such as a magnetic metal (e.g., iron, nickel, cobalt, etc.). As may be understood from this figure, the hinged element 248 is rotatably mounted about an axis of rotation 250, and the two contacts 246 and magnet 244 are spaced apart from the axis of rotation 250. In the embodiment shown in this figure, the hinged element 248 is configured to rotate about the axis of rotation 250 on a hinge. In other embodiments, the hinged portion may rotate about the axis of rotation via any other suitable mechanism (e.g., a pin). As shown in FIG. 25, the plug element's interior portion comprises a magnet 242 (e.g, a cylindrical magnet) that substantially contacts (e.g., contacts) the plug element's magnet portion 226.

As may be understood from FIGS. 25 and 26, as the plug element 16 at least substantially engages the receptacle element 14 (e.g., with the plug element's contacts 228 lined up with the receptacle element's corresponding contact receptacles 232 and the plug element's magnet portion 226 lined up with the receptacle element's magnet receptacle 234), the hinged element's magnet 244 becomes attracted to and substantially engages (e.g., engages) the plug element's magnet portion 226. In response to the hinged element's magnet's attraction to the plug element's magnet portion 226, the hinged portion 248 rotates about the axis of rotation 250 between a first position and a second position in which the hinged portion's contacts 246 at least substantially engage (e.g., engage) the plug element's contacts 228 through the contact receptacles 232. As may be understood from FIG. 26, when the receptacle element 14 is at least substantially engaged (e.g., fully engaged) with the plug element 16, and the plug element's contacts 228 are substantially engaged (e.g., engaged) with the receptacle element's contacts 246, the plug may draw power through a completed circuit (e.g., from a traditional wall outlet).

In various embodiments, the hinged element 248 further comprises a biasing mechanism for biasing the hinged element 248 toward the first position. The biasing mechanism may include, for example, a spring (e.g., a torsion spring, linear spring, etc.) or any other suitable biasing mechanism. In such embodiments, the force attraction (e.g., force of magnetic attraction) between the plug element's magnet portion 226 and the receptacle element's magnet 244 is sufficiently strong to overcome the force of the biasing mechanism biasing the hinged element 248 toward the first position, allowing the plug element's contacts 228 to at least substantially engage (e.g., fully engage) the receptacle element's contacts 246). In particular embodiments, when the receptacle element 14 and plug element 16 are not engaged, the receptacle element's contacts 246 are not exposed to the receptacle element's outer portion (e.g., a user handling the receptacle element could not substantially contact (e.g., touch) the contacts 246). In various embodiments, the hinged element 248 may include any suitable mechanical switch that is configured such that the receptacle element's contacts 246 are positioned to engage corresponding plug element contacts 228 through the contact receptacles 232 when the plug element 16 at least substantially engages the receptacle element 14 and are positioned within the receptacle element (e.g., not exposed to the receptacle element's exterior) when the plug element 16 and receptacle element 14 are not engaged. In particular embodiments, this arrangement may improve the safety of the quick disconnect power adapter.

11. Conclusion

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

I claim:

1. An adapter for use in maintaining an electrical connection between an electrical device and an electrical outlet, said adapter being adapted to facilitate a safe break in said electrical connection, wherein said adapter comprises:

a first connector that comprises a hinged element rotatably mounted about an axis of rotation and disposed in an interior portion of said first connector, said hinged element comprising:

a first set of one or more electrical contacts spaced apart said axis of rotation; and a first magnetic portion spaced apart from said axis of rotation;

a second connector that comprises:

a second set of one or more electrical contacts; and a second magnetic portion, wherein:

said hinged portion is adapted to rotate about said axis of rotation between:

a first position; and a second position in which (A) said first set of one or more electrical contacts engages said second set of one of more electrical contacts when said first connector is adjacent said second connector; and (B) said engagement between said first and second sets of contacts facilitates a communication of electrical current between said first and second connectors;

said first magnetic portion and said second magnetic portion are adapted such that an attractive force between said first and second magnetic portions causes said hinged element to rotate about said axis of rotation from said first position into said second position;

said first magnetic portion and said second magnetic portion are adapted to cooperate to form a releasable connection between said first connector and said second connector; and said first magnetic portion and said second magnetic portion are adapted so that an application of a sufficient force pulling said first connector away from said second connector releases said connection between said first and second connectors so that said first set of electrical contacts disengages from said second set of electrical contacts.

2. The adapter of claim 1, wherein:

said first connector defines one or more contact receptacles that at east generally correspond in size, shape and orientation to said first set of one or more electrical contacts; and said first set of one or more electrical contacts engages said second set of one or more electrical contacts through said one or more contact receptacles when said hinged portion is in said second position and said first connector is adjacent said second connector.

3. The adapter of claim 2, wherein said first set of one or more electrical contacts are at least partially exposed to an outer portion of said first connector through said one or more contact receptacles when said hinged portion is in said second position; and said first set of one or more electrical contacts are not exposed to said outer portion of said first connector when said hinged portion is in said first position.

4. The adapter of claim 2, wherein:

said hinged element comprises a biasing mechanism for biasing said hinged element toward said first position when said first connector is pulled away from said second connector.

5. The adapter of claim 1, wherein:

said first set of electrical contacts comprises at least a first electrical contact and a second electrical contact; and said second set of electrical contacts comprises at least a third electrical contact and a fourth electrical contact.

6. The adapter of claim 1, wherein said adapter is configured so that a human finger cannot contact at least one of said second set of electrical contacts.

7. The adapter of claim 6, wherein said second set of electrical contacts is recessed into said second connector so that at least a particular one of said second set of electrical contacts is only accessible through a passageway that is sufficiently small to prevent a human finger from extending through said passageway and touching said particular electrical contact.

8. The adapter of claim 1, wherein said adapter is configured to render at least one of said first set of electrical contacts unexposed when said first connector is disengaged from said second connector.

9. The adapter of claim 1, wherein first magnetic portion and said second magnetic portion are adapted to maintain said first connector in a particular orientation relative to said second connector.

10. The adapter of claim 2, wherein said second magnetic portion comprises at least one magnet.

11. An adapter for use in maintaining an electrical connection between an electrical device and a source of electricity, said adapter being adapted to facilitate a safe break in said electrical connection, wherein:

said adapter comprises:

a first connector that comprises:

a housing having an interior portion, wherein said housing defines one or more contact receptacles;

a first set of one or more electrical contacts that at least generally correspond in size, shape, and orientation to said one or more contact receptacles, wherein said first set of one or more electrical contacts are adapted to move between: (1) a first position in which said first set of one or more receptacles are disposed within said interior portion of said housing; and (2) a second position in which said first set of one or more electrical contacts are disposed at least partially within said one or more contact receptacles;

a second connector that comprises a second set of one or more electrical contacts, and a magnetic coupling device that is adapted to form a releasable connection between said first connector and said second connector, said magnetic coupling device comprising:

a first magnetic coupling portion operatively coupled to said first set of one or more electrical contacts; and a second magnetic coupling portion operatively coupled to said second connector;

said releasable connection between said first connector and said second connector is such that: (1) said first set of one or more electrical contacts engages said second set of one or more electrical contacts through said one or more contact receptacles when said first set of one or more electrical contacts is in said second position and said first connector is adjacent said second connector; and (2) said engagement between said first and second sets of contacts facilitates a communication of electrical current between said first and second connectors.

12. The adapter of claim 11, wherein:

said first connector is a plug element disposed adjacent a distal end of a power cord for said electrical device; and said second connector is a receptacle element that is adapted to be plugged into said source of electricity so that power flows from said source of electricity to said electrical device through said first and second connectors and said power cord.

13. The adapter of claim 11, wherein said first connector comprises a biasing mechanism for biasing said first set of one or more electrical contacts toward said first position.

14. The adapter of claim 13, wherein:

said first magnetic coupling portion is adapted to become attracted to said second magnetic coupling portion when said first connector is adjacent said second connector, causing said first set of one or more electrical contacts to move from said first position and said second position.

15. The adapter of claim 14, wherein:

a force of attraction between said first magnetic coupling portion and said second magnetic coupling portion is sufficiently strong to overcome a force of said biasing mechanism.

16. The adapter of claim 11, wherein said adapter is configured so that a human finger cannot contact at least one of said second set of electrical contacts.

17. The adapter of claim 16, wherein said second set of electrical contacts is recessed into said second connector so that at least a particular one of said second set of electrical contacts is only accessible through a passageway that is sufficiently small to prevent a human finger from extending through said passageway and touching said particular electrical contact.

18. The adapter of claim 17, wherein said adapter is configured to render at least one of said second set of electrical contacts unexposed when said first connector is disengaged from said second connector.

19. The adapter of claim 11, wherein said first magnetic coupling portion comprises at least one magnet; and said second magnetic coupling portion comprises at least one piece of magnetic material.

* * * * *